US011408406B2

(12) United States Patent
Xu et al.

(10) Patent No.: US 11,408,406 B2
(45) Date of Patent: Aug. 9, 2022

(54) GM CRYOCOOLER AND METHOD OF OPERATING GM CRYOCOOLER

(71) Applicant: SUMITOMO HEAVY INDUSTRIES, LTD., Tokyo (JP)

(72) Inventors: Mingyao Xu, Nishitokyo (JP); Qian Bao, Nishitokyo (JP); Takaaki Morie, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 635 days.

(21) Appl. No.: 16/427,374

(22) Filed: May 31, 2019

(65) Prior Publication Data

US 2019/0316574 A1 Oct. 17, 2019

Related U.S. Application Data

(63) Continuation of application No. PCT/JP2017/042659, filed on Nov. 28, 2017.

(30) Foreign Application Priority Data

Dec. 2, 2016 (JP) ..... JP2016-234924
Aug. 23, 2017 (JP) ..... JP2017-160489

(51) Int. Cl.
*F25B 9/00* (2006.01)
*F25B 9/10* (2006.01)
(Continued)

(52) U.S. Cl.
CPC ..... *F04B 27/005* (2013.01); *F04B 37/085* (2013.01); *F25B 9/14* (2013.01)

(58) Field of Classification Search
CPC ..... F25B 9/00; F25B 9/10; F25B 9/14; F25B 9/145; F25B 2309/002; F25B 2309/006;
(Continued)

(56) References Cited

U.S. PATENT DOCUMENTS 6,629,418 B1 10/2003 Gao et al.
8,499,568 B2 8/2013 Mingyao
(Continued)

FOREIGN PATENT DOCUMENTS

JP H01-210765 A 8/1989
JP H05-047761 U 6/1993
(Continued)

OTHER PUBLICATIONS

JPH0532426Atranslation (Year: 1993).*

*Primary Examiner* — Jianying C Atkisson
*Assistant Examiner* — Erik Mendoza-Wilkenfel
(74) *Attorney, Agent, or Firm* — HEA Law PLLC

(57) ABSTRACT

A GM cryocooler includes a first cold head including a first displacer that is reciprocable in an axial direction, a first drive piston that drives the first displacer in the axial direction, and a first drive chamber that houses the first drive piston; a second cold head including a second displacer that is reciprocable in the axial direction, and a second cylinder that houses the second displacer; a first intake valve that is connected to both the first drive chamber and the second cylinder so as to supply working gas in parallel to the first drive chamber and the second cylinder; and a first exhaust valve that is connected to both the first drive chamber and the second cylinder so as to collect the working gas in parallel from the first drive chamber and the second cylinder.

9 Claims, 18 Drawing Sheets

(51) Int. Cl.
*F25B 9/14* (2006.01)
*F04B 27/00* (2006.01)
*F04B 37/08* (2006.01)

(58) Field of Classification Search
CPC ..... F25B 2309/14; F25B 2309/1406; F25B 2309/1418
See application file for complete search history.

(56) References Cited

U.S. PATENT DOCUMENTS

| | | | | |
|---|---|---|---|---|
| 9,829,218 | B2 | 11/2017 | Xu | |
| 2011/0219810 | A1 * | 9/2011 | Longsworth | F25B 9/06 62/474 |
| 2013/0219923 | A1 | 8/2013 | Mizuno | |

FOREIGN PATENT DOCUMENTS

| | | | | |
|---|---|---|---|---|
| JP | H055312426 | A | * | 11/1993 |
| JP | 2009-257727 | A | | 11/2009 |
| JP | 2013-083428 | A | | 5/2013 |
| JP | 2013-174411 | A | | 9/2013 |

* cited by examiner

GM CRYOCOOLER AND METHOD OF OPERATING GM CRYOCOOLER

RELATED APPLICATIONS

Priority is claimed to Japanese Patent Application No. 2016-234924, filed Dec. 2, 2016, Japanese Patent Application No. 2017-160489, filed Aug. 23, 2017, and International Patent Application No. PCT/JP2017/042659, the entire content of each of which is incorporated herein by reference.

BACKGROUND

Technical Field

Certain embodiments relate to a Gifford-McMahon (GM) cryocooler.

Description of Related Art

GM cryocoolers are roughly divided into two types, a motor driven type and a gas driven type depending on drive sources thereof. In the motor driven type, a displacer is mechanically coupled to a motor and is driven by the motor. In the gas driven type, the displacer is driven by gas pressure.

SUMMARY

According to an embodiment of the invention, a GM cryocooler includes a first cold head including a first displacer that is reciprocable in an axial direction, a first cylinder that houses the first displacer, a first drive piston that drives the first displacer in the axial direction, and a first drive chamber that houses the first drive piston; a second cold head including a second displacer that is reciprocable in the axial direction, a second cylinder that houses the second displacer, a second drive piston that drives the second displacer in the axial direction, and a second drive chamber that houses the second drive piston; a first intake valve that is connected to both the first drive chamber and the second cylinder so as to supply a working gas in parallel to the first drive chamber and the second cylinder; a first exhaust valve that is connected to both the first drive chamber and the second cylinder so as to collect the working gas in parallel from the first drive chamber and the second cylinder; a second intake valve that is connected to both the second drive chamber and the first cylinder so as to supply the working gas in parallel to the second drive chamber and the first cylinder; and a second exhaust valve that is connected to both the second drive chamber and the first cylinder so as to collect the working gas in parallel from the second drive chamber and the first cylinder.

According to an another embodiment of the invention, a GM cryocooler includes a first cold head including a first displacer that is reciprocable in an axial direction, a first drive piston that drives the first displacer in the axial direction, and a first drive chamber that houses the first drive piston; a second cold head including a second displacer that is reciprocable in the axial direction, and a second cylinder that houses the second displacer; a first intake valve that is connected to both the first drive chamber and the second cylinder so as to supply a working gas in parallel to the first drive chamber and the second cylinder; and a first exhaust valve that is connected to both the first drive chamber and the second cylinder so as to collect the working gas in parallel from the first drive chamber and the second cylinder.

According to still another embodiment of the invention, a method of operating a gas-driven multi-cylinder type GM cryocooler is provided. This method includes detaching a first cold head from the GM cryocooler, including detaching a first drive chamber of the first cold head from a first sub-flow path of the GM cryocooler and detaching a first cylinder of the first cold head from a second main flow path of the GM cryocooler; forming a first bypass flow path that connects the second main flow path to first sub-flow path; supplying a working gas to a second cold head installed in the GM cryocooler while the first cold head is detached from the GM cryocooler; and allowing the working gas to the first bypass flow path while the first cold head is detached from the GM cryocooler.

DETAILED DESCRIPTION

Figure 1:
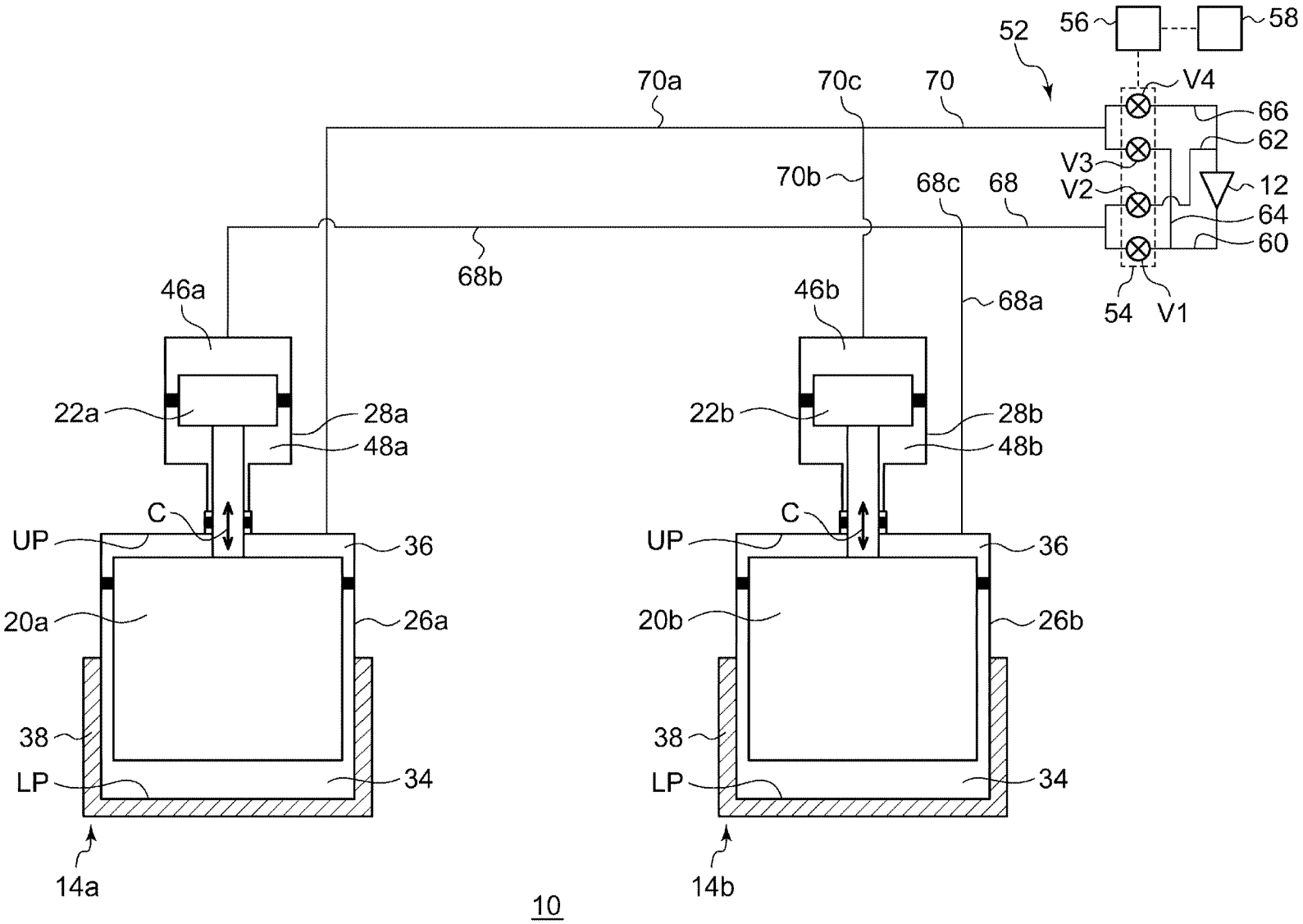
FIG. 1 is a schematic view illustrating a GM cryocooler related to a first embodiment.

Regarding the motor-driven GM cryocoolers, the configuration of two-cylinder type motor-driven GM cryocoolers that drive two displacers by one motor is suggested. However, attempts to construct two-cylinder type gas-driven GM cryocoolers are rare.

It is desirable to provide a multi-cylinder type GM cryocooler suitable for practical use.

In addition, optional combinations of the above constituent elements and those obtained by substituting the constituent elements or expressions of the invention with each other among methods, devices, systems, and the like are also effective as embodiments of the inventions.

According to the invention, it is possible to provide the multi-cylinder type GM cryocooler suitable for practical use.

Hereinafter, embodiments for carrying out the invention will be described in detail. In addition, the configuration to be described below is merely exemplary and does not limit the range of the invention at all. Additionally, in the description of the drawing, the same elements will be designated by the same reference signs, and the duplicate description thereof will be appropriately omitted. Additionally, in the drawings to be referred to in the following description, the size and thickness of respective constituent members are for convenience of description, and do not necessarily indicate actual dimensions and ratios.

First Embodiment

FIG. 1 is a schematic view illustrating a GM cryocooler 10 related to a first embodiment.

The GM cryocooler 10 is of a multi-cylinder type. Therefore, the GM cryocooler 10 includes a compressor 12 that compresses a working gas (for example, helium gas), and a plurality of cold head that cools the working gas by adiabatic expansion. Each cold head is also referred to as an expander. Since the GM cryocooler 10 illustrated has two cold heads, the GM cryocooler 10 is also referred to as a two-cylinder type.

As will be described below in detail, the compressor 12 supplies a high-pressure working gas to the cold head. The cold head is provided with a regenerator that pre-cools the working gas. The pre-cooled working gas is further cooled by expansion within the cold head. The working gas is collected in the compressor 12 through the regenerator. The working gas cools the regenerator when the working gas passes through the regenerator. The compressor 12 compresses the collected working gas and supplies the compressed working gas to the expander again.

The GM cryocooler 10 includes a first cold head 14*a* and a second cold head 14*b* that are disposed in parallel. These cold heads are of single stage types. However, the GM cryocooler 10 may include multistage type cold heads.

The first cold head 14*a* includes a first displacer 20*a* that is reciprocable in an axial direction (an upward-downward direction in FIGS. 1 and 2, indicated by an arrow C), a first cylinder 26*a* that houses the first displacer 20*a*, a first drive piston 22*a* that drives the first displacer 20*a* in the axial direction, and a first drive chamber 28*a* that houses the first drive piston 22*a*. Similarly, the second cold head 14*b* includes a second displacer 20*b* that is reciprocable in the axial direction, a second cylinder 26*b* that houses the second displacer 20*b*, a second drive piston 22*b* that drives the second displacer 20*b* in the axial direction, and a second drive chamber 28*b* that houses the second drive piston 22*b*.

Additionally, the GM cryocooler 10 includes a working gas circuit 52 that connects the compressor 12 to the first cold head 14*a* and the second cold head 14*b*. The working gas circuit 52 is configured so as to cause a pressure difference between the first drive chamber 28*a* and the first cylinder 26*a*. Additionally, the working gas circuit 52 is configured so as to cause a pressure difference between the second drive chamber 28*b* and the second cylinder 26*b*. The first displacer 20*a* and the first drive piston 22*a* move in the axial direction due to the pressure difference. If the pressure of the first cylinder 26*a* is lower than that of the first drive chamber 28*a*, the first drive piston 22*a* moves downward, and the first displacer 20*a* also moves downward along with this. On the contrary, if the pressure of the first cylinder 26*a* is higher than that of the first drive chamber 28*a*, the first drive piston 22*a* moves upward, and the first displacer 20*a* also moves upward along with this. Also in the second cold head 14*b*, similarly, the second displacer 20*b* and the second drive piston 22*b* move in the axial direction due to the pressure difference.

The working gas circuit 52 includes a valve unit 54 that is shared by the first cold head 14*a* and the second cold head 14*b*. The valve unit 54 includes a first intake valve V1, a first exhaust valve V2, a second intake valve V3, and a second exhaust valve V4. Although described below in detail, the valve unit 54 is configured so as to drive the first cold head 14*a* and the second cold head 14*b* in the same cycle and in opposite phases.

The first intake valve V1 connects a discharge port of the compressor 12 is connected to both the first drive chamber 28*a* and the second cylinder 26*b* so as to supply the working gas in parallel to the first drive chamber 28*a* and the second cylinder 26*b*. The first exhaust valve V2 connects an intake port of the compressor 12 to both the first drive chamber 28*a* and the second cylinder 26*b* so as to collect the working gas from the first drive chamber 28*a* and the second cylinder 26*b* in parallel. The second intake valve V3 connects a discharge port of the compressor 12 to both the second drive chamber 28*b* and the first cylinder 26*a* so as to supply the working gas in parallel to the second drive chamber 28*b* and the first cylinder 26*a*. The second exhaust valve V4 connects an intake port of the compressor 12 to both the second drive chamber 28*b* and the first cylinder 26*a* so as to collect the working gas from the second drive chamber 28*b* and the first cylinder 26*a* in parallel.

Figure 2:
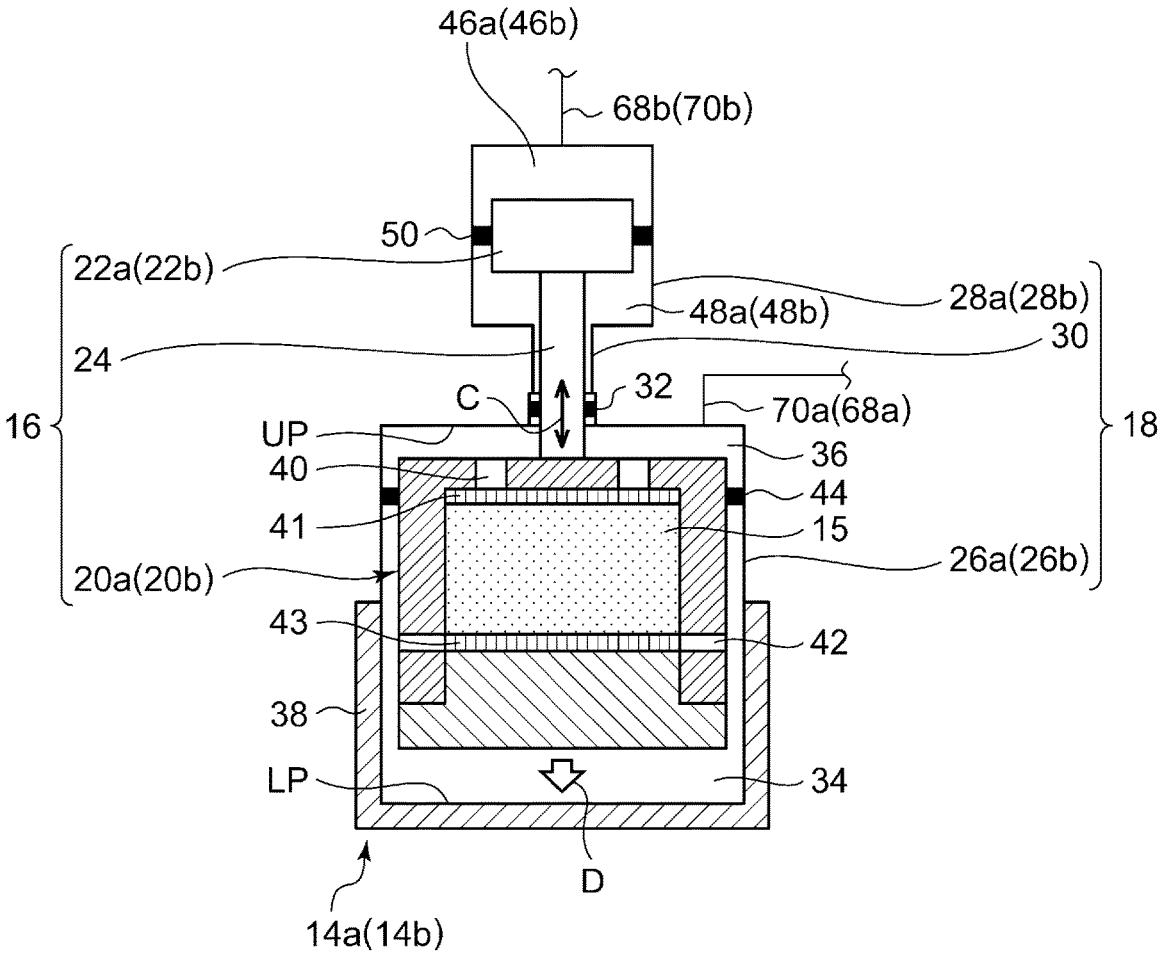
FIG. 2 is a schematic view illustrating a cold head of the GM cryocooler.

FIG. 2 is a schematic view illustrating the first cold head 14*a* of the GM cryocooler 10. The second cold head 14*b* has the same configuration as the first cold head 14*a*. Therefore, in the following description, the "first cold head 14*a*", the "first displacer 20*a*", the "first drive piston 22*a*", the "first cylinder 26*a*", the "first drive chamber 28*a*", and the like can be read as the "second cold head 14*b*", the "second displacer 20*b*", the "second drive piston 22*b*", the "second cylinder 26*b*", the "second drive chamber 28*b*", or the like, respectively.

The first cold head 14*a* is of a gas driven type. Therefore, the first cold head 14*a* includes an axial movable body 16 serving as a free piston to be driven by gas pressure, and a cold head housing 18 that is airtightly configured and houses the axial movable body 16. The cold head housing 18 supports the axial movable body 16 so as to be reciprocable in the axial direction. Unlike a motor-driven GM cryocooler, the first cold head 14*a* does not have a motor that drives the axial movable body 16, and a coupling mechanism (for example, a scotch yoke mechanism).

The above-described valve unit 54 may be disposed in the middle of the cold head housing 18 of the first cold head 14*a* (or the second cold head 14*b*) and may be connected to the compressor 12 and other cold heads by piping. The valve unit 54 may be disposed outside the cold head housing 18 and may be connected to the compressor 12, the first cold head 14*a*, and the second cold head 14*b* by piping.

The axial movable body 16 includes the first displacer 20*a* and the first drive piston 22*a*. The first drive piston 22*a* is disposed coaxially with the first displacer 20*a* and apart therefrom in the axial direction.

The cold head housing 18 includes the first cylinder 26*a* and the first drive chamber 28*a*. The first drive chamber 28*a* is disposed coaxially with the first cylinder 26*a* and adjacent thereto in the axial direction.

Although described below in detail, a drive unit of the first cold head 14*a* that is of the gas driven type is configured to include the first drive piston 22*a* and the first drive chamber 28*a*. Additionally, the first cold head 14*a* includes a gas spring mechanism that acts on the first drive piston 22*a* so as to alleviate or prevent a collision or contact between the first displacer 20*a* and the first cylinder 26*a*.

Additionally, the axial movable body 16 includes a coupling rod 24 that rigidly couples the first displacer 20*a* to the first drive piston 22*a* such that the first displacer 20*a* reciprocates in the axial direction integrally with the first drive piston 22*a*. The coupling rod 24 also extends from the first displacer 20*a* to the first drive piston 22*a* coaxially with the first displacer 20*a* and the first drive piston 22*a*.

The first drive piston 22*a* has dimensions smaller than the first displacer 20*a*. The axial length of the first drive piston 22*a* is shorter than that of the first displacer 20*a*, and the diameter of the first drive piston 22*a* is also smaller than that of the first displacer 20*a*. The diameter of the coupling rod 24 is smaller than that of the first drive piston 22*a*.

The volume of the first drive chamber 28*a* is smaller than that of the first cylinder 26*a*. The axial length of the first drive chamber 28*a* is shorter than that of the first cylinder 26*a*, and the diameter of the first drive chamber 28*a* is also smaller than that of the first cylinder 26*a*.

In addition, a dimensional relationship between the first drive piston 22*a* and the first displacer 20*a* is not limited to the above-described one, and may be different from that. Similarly, a dimensional relationship between the first drive chamber 28*a* and the first cylinder 26*a* is not limited to the above-described one, and may be different from that.

The axial reciprocation of the first displacer 20*a* is guided by the first cylinder 26*a*. Typically, the first displacer 20*a* and the first cylinder 26*a* are respectively cylindrical members that extend in the axial direction, and the internal diameter of the first cylinder 26*a* coincides with or is slightly larger than the external diameter of the first displacer 20*a*. Similarly, the axial reciprocation of the first drive piston 22*a* is guided by the first drive chamber 28*a*. Typically, the first drive piston 22*a* and the first drive chamber 28*a* are respectively cylindrical members that extend in the axial direction, and the internal diameter of the first drive chamber 28*a* coincides with or is slightly larger than the external diameter of the first drive piston 22*a*.

Since the first displacer 20*a* and the first drive piston 22*a* are rigidly coupled to each other by the coupling rod 24, the axial stroke of the first drive piston 22*a* is equal to the axial stroke of the first displacer 20*a*, and both the displacer and the drive piston move integrally over the entire stroke. The position of the first drive piston 22*a* with respect to the first displacer 20*a* is invariable during the axial reciprocation of the axial movable body 16.

Additionally, the cold head housing 18 includes a coupling rod guide 30 that connects the first cylinder 26*a* to the first drive chamber 28*a*. The coupling rod guide 30 extends from the first cylinder 26*a* to the first drive chamber 28*a* coaxially with the first cylinder 26*a* and the first drive chamber 28*a*. The coupling rod 24 passes through the coupling rod guide 30. The coupling rod guide 30 is configured as a bearing that guides the axial reciprocation of the coupling rod 24.

The first cylinder 26*a* is airtightly coupled with the first drive chamber 28*a* via the coupling rod guide 30. In this way, the cold head housing 18 is configured as a pressure vessel for the working gas. In addition, the coupling rod guide 30 may be regarded as being a portion of the first cylinder 26*a* or the first drive chamber 28*a*.

A first seal part 32 is provided between the coupling rod 24 and the coupling rod guide 30. The first seal part 32 is mounted on any one of the coupling rod 24 or the coupling rod guide 30, and slides on the other of the coupling rod 24 or the coupling rod guide 30. The first seal part 32 is constituted of, for example, a seal member, such as a slipper seal or an O-ring. The first drive chamber 28*a* is airtightly configured with respect to the first cylinder 26*a* by the first seal part 32. In this way, the first drive chamber 28*a* is fluidically isolated from the first cylinder 26*a*, and a direct gas flow between the first drive chamber 28*a* and the first cylinder 26*a* is not generated.

The first cylinder 26*a* is partitioned into an expansion chamber 34 and a room temperature chamber 36 by the first displacer 20*a*. The first displacer 20*a* forms the expansion chamber 34 between the first displacer 20*a* and the first cylinder 26*a* at one axial end thereof, and forms the room temperature chamber 36 between the first displacer 20*a* and the first cylinder 26*a* at the other axial end thereof. The expansion chamber 34 is disposed on a bottom dead center LP side, and the room temperature chamber 36 is disposed on a top dead center UP side. Additionally, the first cold head 14*a* is provided with a cooling stage 38 anchored to the first cylinder 26*a* so as to envelop the expansion chamber 34.

The regenerator 15 is built in the first displacer 20*a*. The first displacer 20*a* has an inlet flow path 40, which allows the regenerator 15 to communicate with the room temperature chamber 36, at an upper lid part thereof. Additionally, the first displacer 20*a* has an outlet flow path 42, which allows the regenerator 15 to communicate with the expansion chamber 34, at a tube part thereof. Alternatively, the outlet flow path 42 may be provided at a lower lid part of the first displacer 20*a*. In addition, the first displacer 20*a* includes an inlet flow straightener 41 inscribed on the upper lid part, and an outlet flow straightener 43 inscribed on the lower lid part. The regenerator 15 is sandwiched between a pair of such flow straighteners.

A second seal part 44 is provided between the first displacer 20*a* and the first cylinder 26*a*. The second seal part 44 is, for example, a slipper seal and is mounted on the tube part or the upper lid part of the first displacer 20*a*. Since a clearance between the first displacer 20*a* and the first cylinder 26*a* is sealed by the second seal part 44, there is no direct gas flow (that is, a gas flow that bypasses the regenerator 15) between the room temperature chamber 36 and the expansion chamber 34.

When the first displacer 20*a* moves in the axial direction, the expansion chamber 34 and the room temperature chamber 36 are complementarily increased or decreased in volume. That is, when the first displacer 20*a* moves downward, the expansion chamber 34 becomes narrow and the room temperature chamber 36 becomes wide. The reverse is also the same.

The working gas flows from the room temperature chamber 36 through the inlet flow path 40 into the regenerator 15. More exactly, the working gas flows from the inlet flow path 40 through the inlet flow straightener 41 into the regenerator 15. The working gas flows from the regenerator 15 via the outlet flow straightener 43 and the outlet flow path 42 into the expansion chamber 34. When the working gas returns from the expansion chamber 34 to the room temperature chamber 36, the working gas passes through a reverse route. That is, the working gas returns from the expansion chamber 34 through the outlet flow path 42, the regenerator 15, and the inlet flow path 40 to the room temperature chamber 36. The working gas to bypass the regenerator 15 and flow through the clearance is blocked by the second seal part 44.

The first drive chamber 28*a* includes a first compartment 46*a* of which the pressure is controlled to drive the first drive piston 22*a*, and a first gas spring chamber 48*a* that is partitioned from the first compartment 46*a* by the first drive piston 22*a*. The first drive piston 22*a* forms the first compartment 46*a* between first drive piston 22*a* and the first drive chamber 28*a* at one axial end thereof, and forms the first gas spring chamber 48*a* between the first drive piston 22*a* and the first drive chamber 28*a* at the other axial end thereof. When the first drive piston 22*a* moves in the axial direction, the first compartment 46*a* and the first gas spring chamber 48*a* are complementarily increased or decreased in volume.

The first compartment 46*a* is disposed opposite to the first cylinder 26*a* in the axial direction with respect to the first drive piston 22*a*. The first gas spring chamber 48*a* is disposed on the same side as the first cylinder 26*a* in the axial direction with respect to the first drive piston 22*a*. An upper surface of the first drive piston 22*a* receives the gas pressure of the first compartment 46*a*, and a lower surface of the first drive piston 22*a* receives the gas pressure of the first gas spring chamber 48*a*.

Similarly, the second drive chamber 28*b* includes a second compartment 46*b* of which the pressure is controlled to drive the second drive piston 22*b*, and a second gas spring chamber 48*b* that is partitioned from the second compartment 46*b* by the second drive piston 22*b*.

The coupling rod 24 extends from the lower surface of the first drive piston 22*a* through the first gas spring chamber 48*a* to the coupling rod guide 30. Moreover, the coupling rod 24 extends to the upper lid part of the first displacer 20*a* through the room temperature chamber 36. The first gas spring chamber 48*a* is disposed on the same side as the coupling rod 24 with respect to the first drive piston 22*a*, and the first compartment 46*a* is disposed opposite to the coupling rod 24 with respect the first drive piston 22*a*.

A third seal part 50 is provided between the first drive piston 22*a* and the first drive chamber 28*a*. The third seal part 50 is, for example, a slipper seal and is mounted on a side surface of the first drive piston 22*a*. Since a clearance between the first drive piston 22*a* and the first drive chamber 28*a* is sealed by the third seal part 50, there is no direct gas flow between the first compartment 46*a* and the first gas spring chamber 48*a*. Additionally, since the first seal part 32 is provided, there is also no gas flow between the first gas spring chamber 48*a* and the room temperature chamber 36. In this way, the first gas spring chamber 48*a* is airtightly formed with respect to the first cylinder 26*a*. The first gas spring chamber 48*a* is sealed by the first seal part 32 and the third seal part 50.

When the first drive piston 22*a* moves downward, the first gas spring chamber 48*a* becomes narrow. In this case, the gas of the first gas spring chamber 48*a* is compressed, and the pressure thereof is increased. The pressure of the first gas spring chamber 48*a* acts on the lower surface of the first drive piston 22*a* upward. Therefore, the first gas spring chamber 48*a* generates a gas spring force that resists the downward movement of the first drive piston 22*a*.

On the contrary, when the first drive piston 22*a* moves upward, the first gas spring chamber 48*a* becomes wide. The pressure of the first gas spring chamber 48*a* drops, and the gas spring force acting on the first drive piston 22*a* also becomes small. In addition, in this case, the first compartment 46*a* becomes narrow. Therefore, while the second intake valve V3 and the second exhaust valve V4 are closed, the first compartment 46*a* can also be regarded as another gas spring chamber that generates a downward gas spring force that resists the upper movement of the first drive piston 22*a*.

The first cold head 14*a* is installed in the illustrated orientation in a field where the cold head 14*a* is to be used. That is, the first cold head 14*a* is installed in a vertical orientation such that the first cylinder 26*a* is disposed on a vertically lower side and the first drive chamber 28*a* is disposed on a vertically upper side. In this way, when the cooling stage 38 is installed in a posture that faces vertically downward, the cryocooling capacity of the GM cryocooler 10 becomes the highest. However, the arrangement of the GM cryocooler 10 is not limited to this. On the contrary, the first cold head 14*a* may be installed in a posture in which the cooling stage 38 faces vertically upward. Alternatively, the first cold head 14*a* may be installed sideways or in other orientations.

As described above, since the first cold head 14*a* is installed in a posture in which the cooling stage 38 faces vertically downward, gravity acts downward as indicated by an arrow D in FIG. 2. For that reason, the weight of the axial movable body 16 acts to assist in the downward driving force of the first drive piston 22*a*. A larger driving force acts on the first drive piston 22*a* during the downward movement compared to during the upper movement. Therefore, in the typical gas-driven GM cryocooler, a collision or contact between a displacer and a displacer cylinder easily occurs at a bottom dead center of the displacer.

However, the first cold head 14*a* is provided with the first gas spring chamber 48*a*. The gas stored in the first gas spring chamber 48*a* is compressed when the first drive piston 22*a* moves downward, and the pressure thereof is increased. Since this pressure acts in a direction opposite to gravity, the driving force that acts on the first drive piston 22*a* becomes small. The speed just before the first drive piston 22*a* reaches the bottom dead center can be reduced.

In this way, a contact or collision between the first drive piston 22*a* and the first drive chamber 28*a* and/or between the first displacer 20*a* and the first cylinder 26*a* can be avoided. Alternatively, since collision energy is reduced due to speed reduction of the first drive piston 22*a*, for example, even if a collision has occurred, collision sound is suppressed.

The GM cryocooler 10 may include at least one of the first gas spring chamber 48*a* and the second gas spring chamber 48*b*.

FIG. 1 is referred to again. The valve unit 54 may take a rotary valve type. That is, the valve unit 54 may be configured such that the valves V1 to V4 are appropriately switched depending on rotational sliding of a valve disc with respect to a valve body. In that case, the valve unit 54 may include a rotational driving source 56 for rotationally driving the valve unit 54 (for example, the valve disc). The rotational driving source 56 is a motor. However, the rotational driving source 56 is not connected to the axial movable body 16 illustrated in FIG. 2. Additionally, the valve unit 54 may include a control unit 58 that controls the valve unit 54. The control unit 58 may control the rotational driving source 56.

In a certain embodiment, the valve unit 54 includes controllable a plurality of individually controllable valves V1 to V4, and the control unit 58 may control opening and closing of the respective valves V1 to V4. In this case, the valve unit 54 may not include the rotational driving source 56.

The working gas circuit 52 of the GM cryocooler 10 includes a first intake flow path 60, a first exhaust flow path 62, a second intake flow path 64, a second exhaust flow path 66, a first branch flow path 68, and a second branch flow path 70.

The first intake flow path 60 connects the discharge port of the compressor 12 to the first intake valve V1. The first exhaust flow path 62 connects the intake port of the compressor 12 to the first exhaust valve V2. The second intake flow path 64 connects the discharge port of the compressor 12 to the second intake valve V3. The second exhaust flow path 66 connects the intake port of the compressor 12 to the second exhaust valve V4. As illustrated, a portion of the second intake flow path 64 may be shared with the first intake flow path 60 on the compressor 12 side. Additionally, a portion of second exhaust flow path 66 may be shared with the first exhaust flow path 62 on the compressor 12 side.

The first branch flow path 68 connects the first drive chamber 28*a* to both the first intake valve V1 and the first exhaust valve V2, and connects the second cylinder 26*b* to both the first intake valve V1 and the first exhaust valve V2. The first branch flow path 68 includes a first main flow path 68*a* connected to the second cylinder 26*b*, a first sub-flow path 68*b* connected to the first drive chamber 28*a*, and a first branch point 68*c* where the first sub-flow path 68*b* branches from the first main flow path 68*a*. The first main flow path 68*a* is connected to the room temperature chamber 36 of the second cold head 14*b*, and the first sub-flow path 68*b* is connected to the first compartment 46*a* of the first drive chamber 28*a*. The first branch flow path 68 connects the first intake valve V1 to both the first main flow path 68*a* and the first sub-flow path 68*b*, and connects the first exhaust valve V2 to both the first main flow path 68*a* and the first sub-flow path 68*b*.

The second branch flow path 70 connects the first cylinder 26*a* to both the second intake valve V3 and the second exhaust valve V4, and connects the second drive chamber 28*b* to both the second intake valve V3 and the second exhaust valve V4. The second branch flow path 70 includes a second main flow path 70*a* connected to the first cylinder 26*a*, a second sub-flow path 70*b* connected to the second drive chamber 28*b*, and a second branch point 70*c* where the second sub-flow path 70*b* branches from the second main flow path 70*a*. The second main flow path 70*a* is connected to the room temperature chamber 36 of the first cold head 14*a*, and the second sub-flow path 70*b* is connected to the second compartment 46*b* of the second drive chamber 28*b*. The second branch flow path 70 connects the second intake valve V3 to both the second main flow path 70*a* and the second sub-flow path 70*b*, and connects the second exhaust valve V4 to both the second main flow path 70*a* and the second sub-flow path 70*b*.

Figure 3:
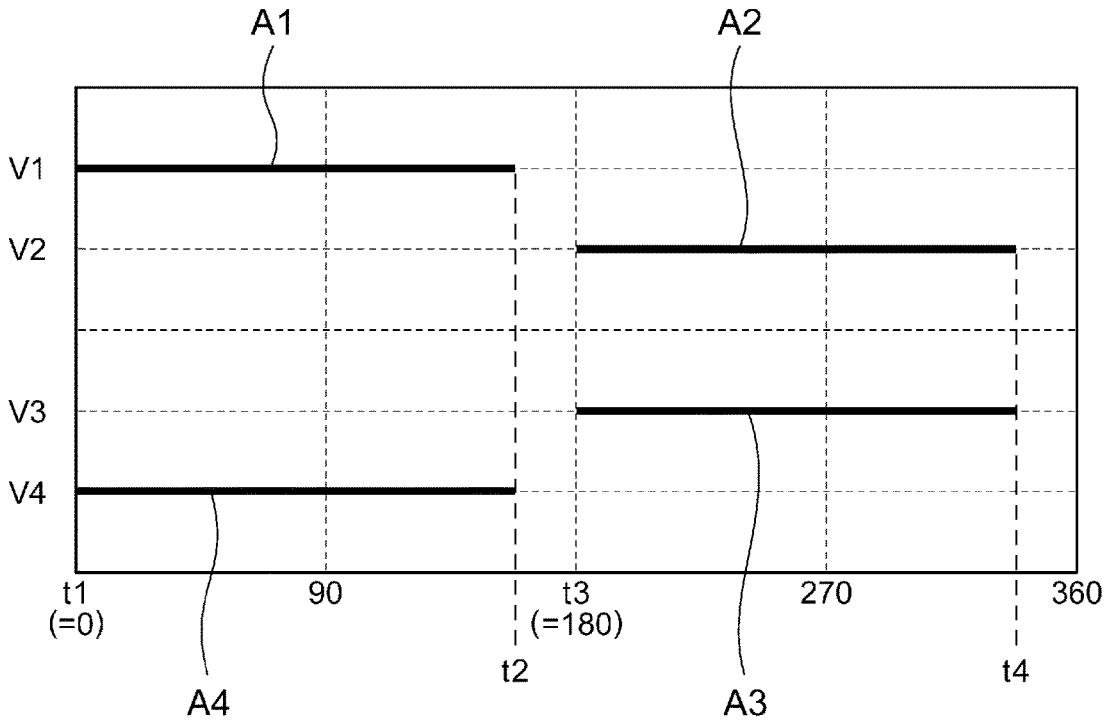
FIG. 3 is a view illustrating an example of the operation of the GM cryocooler.

FIG. 3 illustrates an example of the operation of the GM cryocooler 10. Since one cycle of the axial reciprocation of the axial movable body 16 is represented in correspondence with 360 degrees in FIG. 3, 0 degree corresponds to a start point of the cycle, and 360 degrees corresponds to an end point of the cycle. 90 degrees, 180 degrees, and 270 degrees correspond to ¼ cycle, half cycle, and ¾ cycle, respectively. In addition, valve timings illustrated in FIG. 3 are also applicable to those of second to fifth embodiments to be described below as well as the first embodiment.

A first intake period A1 and a first exhaust period A2 of the second cold head 14*b* and a second intake period A3 and a second exhaust period A4 of the first cold head 14*a* are illustrated in FIG. 3. The first intake period A1, the first exhaust period A2, the second intake period A3, and the second exhaust period A4 are determined by the first intake valve V1, the first exhaust valve V2, the second intake valve V3, and the second exhaust valve V4, respectively.

In the first intake period A1 (that is, when the first intake valve V1 is open), the working gas is supplied from the discharge port of the compressor 12 through the first main flow path 68*a* to the room temperature chamber 36 of the second cold head 14*b*. In parallel, the working gas is supplied also to the first drive chamber 28*a* through the first sub-flow path 68*b*. Conversely, when the first intake valve V1 is closed, supply of the working gas from the compressor 12 to the both these chambers is stopped.

In the first exhaust period A2 (that is, when the first exhaust valve V2 is open), the working gas is collected from the room temperature chamber 36 of the second cold head 14*b* through the first main flow path 68*a* to the intake port of the compressor 12. In parallel, the working gas is collected also from the first drive chamber 28*a* through the first sub-flow path 68*b*. When the first exhaust valve V2 is closed, the collection of the working gas from both these chambers to the compressor 12 is stopped.

In the second intake period A3 (that is, when the second intake valve V3 is open), the working gas is supplied from the discharge port of the compressor 12 through the second main flow path 70*a* to the room temperature chamber 36 of the first cold head 14*a*. In parallel, the working gas is supplied also to the second drive chamber 28*b* through the second sub-flow path 70*b*. Conversely, when the second intake valve V3 is closed, supply of the working gas from the compressor 12 to the both these chambers is stopped.

In the second exhaust period A4 (that is, when the second exhaust valve V4 is open), the working gas is collected from the room temperature chamber 36 of the first cold head 14*a* through the second main flow path 70*a* to the intake port of the compressor 12. In parallel, the working gas is collected also from the second drive chamber 28*b* through the second sub-flow path 70*b*. When the second exhaust valve V4 is closed, the collection of the working gas from both these chambers to the compressor 12 is stopped.

In an example illustrated in FIG. 3, the first intake period A1 and the second exhaust period A4 are within a range of a first start timing t1 to a first end timing t2, and the first exhaust period A2 and the second intake period A3 are within a range of a second start timing t3 to a second end timing t4. The first start timing t1 is, for example, 0 degree. The first end timing t2 is selected from a range of, for example, 135 to 180 degrees. The second start timing t3 is, for example, 180 degrees. The second end timing t4 is selected from a range of, for example, 315 to 360 degrees.

The first intake period A1 alternates with and does not overlap the first exhaust period A2, and the second intake period A3 alternates and does not overlap the second exhaust period A4. The first intake period A1 overlaps the second exhaust period A4, and the first exhaust period A2 overlaps the second intake period A3. The axial movable body 16 is located at or near the bottom dead center LP at the first start timing t1, and the axial movable body 16 is located at or near the top dead center UP at the second start timing t3.

In addition, the first intake period A1 may not exactly coincide with the second exhaust period A4. The second exhaust period A4 at least partially overlap the first intake period A1. Similarly, the first exhaust period A2 may not exactly coincide with the second intake period A3. The second intake period A3 may at least partially overlap the first exhaust period A2.

In the above-described embodiment, the second intake period A3 does not overlap the first intake period A1.

Additionally, the second exhaust period A4 does not overlap the first exhaust period A2. In this way, the intake and exhaust timings from the compressor 12 to the first cold head 14*a* completely deviate from the intake and exhaust timings from the compressor 12 to the second cold head 14*b*. In this way, the fluctuation between high and lower pressures of the compressor 12 can be suppressed, and the efficiency of the compressor 12 can be improved.

In order to obtain such advantages, the intake and exhaust timings of the two cold heads may not completely deviate from each other. The second intake period A3 may be delayed preferably 150 degrees or more from the first intake period A1. Along with this or instead of this, the second exhaust period A4 may be delayed preferably 150 degrees or more from the first exhaust period A2.

In addition, the first intake period A1 and the second exhaust period A4 may be different from each other in length. Similarly, the first exhaust period A2 and the second intake period A3 may be different from each other in length. A difference between an intake period and an exhaust period may be, for example, within 20 degrees or within 5 degrees. In this way, a difference in cryocooling capacity between the first cold head 14*a* and the second cold head 14*b* may be adjusted.

Additionally, the first intake period A1 and the first exhaust period A2 may be different from each other in length. Similarly, the second intake period A3 and the second exhaust period A4 may be different from each other in length. Even in this case, a difference between an intake period and an exhaust period may be, for example, within 20 degrees or within 5 degrees.

Figure 4:
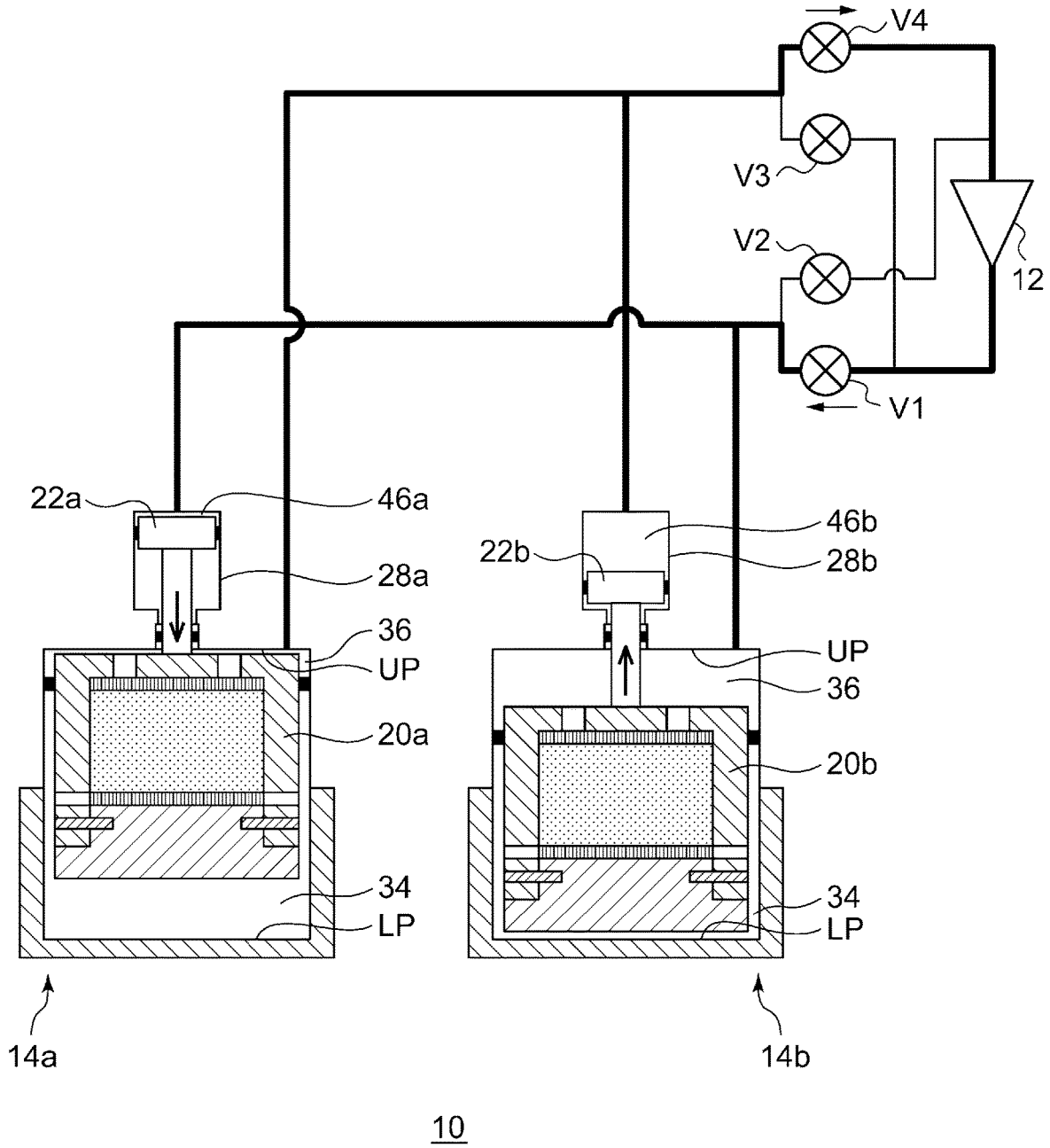
FIG. 4 is a view for explaining the operation of the GM cryocooler.
Figure 5:
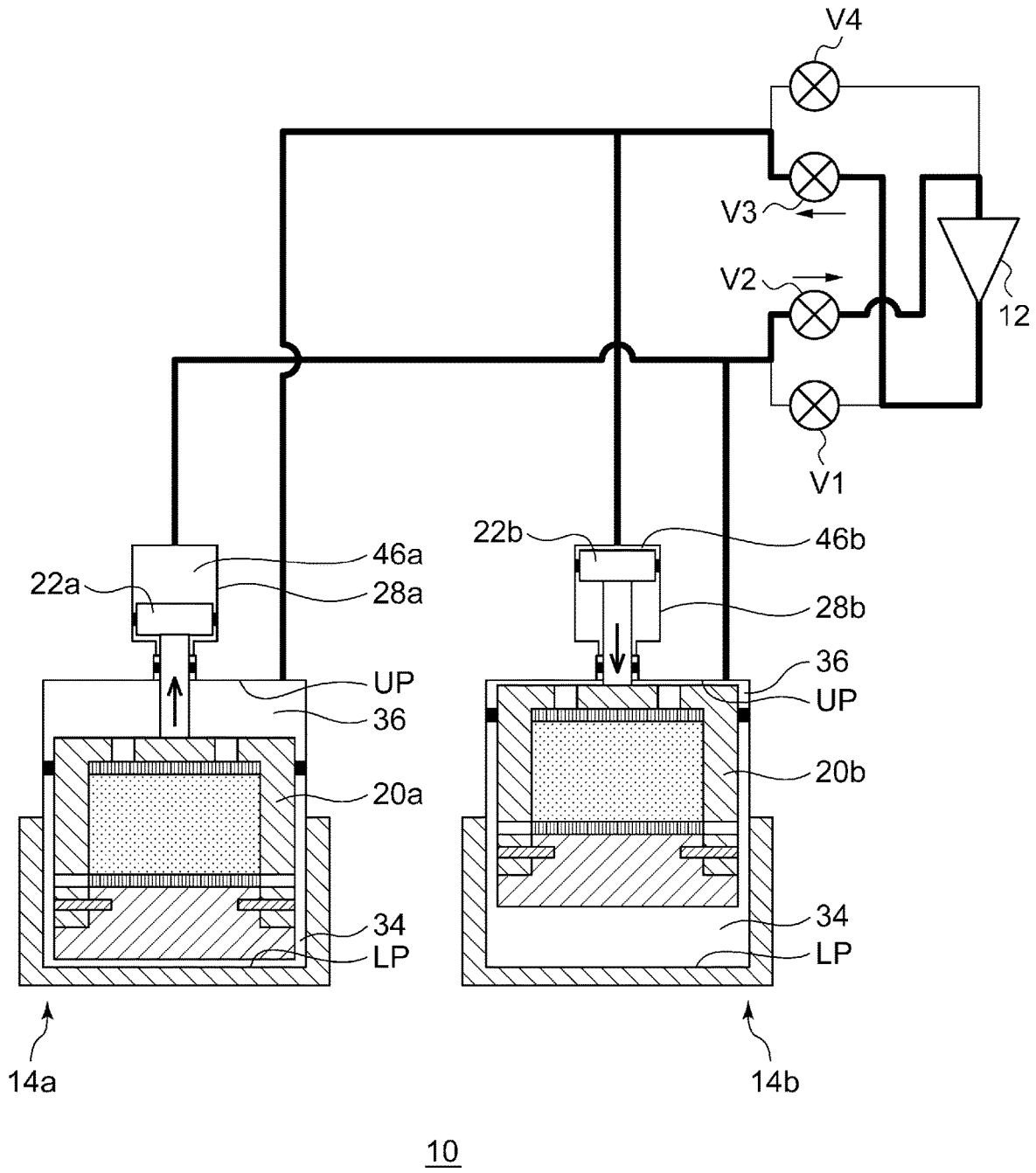
FIG. 5 is a view for explaining the operation of the GM cryocooler.
Figure 6:
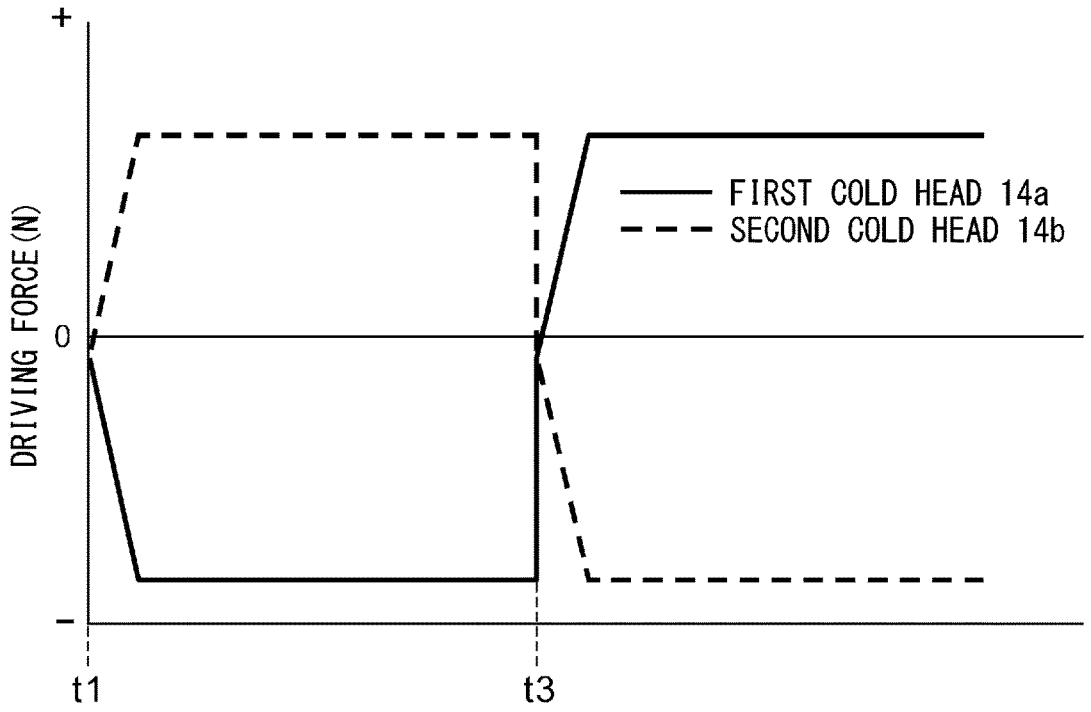
FIG. 6 is a view that illustrates the driving force of the GM cryocooler.

In addition to FIGS. 1 to 3, the operation of the GM cryocooler 10 having the above configuration will be described with reference to FIGS. 4 to 6. The positions of the first displacer 20*a* and the second displacer 20*b* at the first start timing t1 are illustrated in FIG. 4. The positions of the first displacer 20*a* and the second displacer 20*b* at the second start timing t3 are illustrated in FIG. 5. Changes in driving force of the first cold head 14*a* and the second cold head 14*b* in the operation of one cycle of the GM cryocooler 10 is illustrated in FIG. 6. In FIG. 6, in the axial direction, an upward driving force is represented as positive, and a downward driving force is represented as negative.

When the second displacer 20*b* is located at or near the bottom dead center LP of the second cylinder 26*b*, the first intake period A1 is started (the first start timing t1). As illustrated in FIG. 4, the first intake valve V1 is opened, and a high-pressure gas is supplied from the discharge port of the compressor 12 to the room temperature chamber 36 of the second cold head 14*b*. The gas is cooled while passing through the regenerator 15, and enters the expansion chamber 34 of the second cold head 14*b*.

The second exhaust period A4 is also started simultaneously with the first intake period A1. The second exhaust valve V4 is opened, and the second compartment 46*b* of the second drive chamber 28*b* is connected to the intake port of the compressor 12. Therefore, the second drive chamber 28*b* has a pressure lower than the room temperature chamber 36 and the expansion chamber 34. Therefore, as illustrated in FIG. 6, in the second cold head 14*b*, the upward driving force acts on the second drive piston 22*b*.

Due to the upper movement of the second drive piston 22*b*, the second displacer 20*b* also moves from the bottom dead center LP toward the top dead center UP. The first intake valve V1 is closed and the first intake period A1 is ended, and the second exhaust valve V4 is closed and the second exhaust period A4 is ended (the first end timing t2). The second drive piston 22*b* and the second displacer 20*b* continue moving toward the top dead center UP. In this way, the expansion chamber 34 of the second cold head 14*b* is increased in volume and filled with the high-pressure gas.

On the other hand, if the second exhaust period A4 is started, the expansion chamber 34 of the first cold head 14*a* is connected to the intake port of the compressor 12. In this case, the first displacer 20*a* is located at or near the top dead center UP of the first cylinder 26*a*. The high-pressure gas is expanded by the expansion chamber 34 and is cooled. The expanded gas is collected in the compressor 12 through the room temperature chamber 36 while cooling the regenerator 15.

Additionally, if the first intake period A1 is started, the first compartment 46*a* of the first drive chamber 28*a* is connected to the discharge port of the compressor 12. Therefore, the first drive chamber 28*a* has a pressure higher than the room temperature chamber 36 and the expansion chamber 34, and as illustrated in FIG. 6, the downward driving force acts on the first drive piston 22*a* of the first cold head 14*a*. The first drive piston 22*a* and the first displacer 20*a* move from the top dead center UP toward the bottom dead center LP, and a low-pressure gas is discharged from the expansion chamber 34 of the first cold head 14*a*.

In this way, an exhaust process is performed in the first cold head 14*a*, and in parallel with this, an intake process is performed in the second cold head 14*b*.

Subsequently, when the second displacer 20*b* is located at or near the top dead center UP of the second cylinder 26*b*, the first exhaust period A2 is started (the second start timing t3). As illustrated in FIG. 5, the first exhaust valve V2 is opened, and the expansion chamber 34 of the second cold head 14*b* is connected to the intake port of the compressor 12. The high-pressure gas is expanded by the expansion chamber 34 and is cooled. The expanded gas is collected in the compressor 12 through the room temperature chamber 36 while cooling the regenerator 15.

The second intake period A3 is also started simultaneously with the first exhaust period A2. The second intake valve V3 is opened, and the second compartment 46*b* of the second drive chamber 28*b* is connected to the discharge port of the compressor 12. Therefore, the second drive chamber 28*b* has a pressure higher than the room temperature chamber 36 and the expansion chamber 34. Therefore, as illustrated in FIG. 6, in the second cold head 14*b*, the downward driving force acts on the second drive piston 22*b*.

Due to the downward movement of the second drive piston 22*b*, the second displacer 20*b* also moves from the top dead center UP toward the bottom dead center LP. The first exhaust valve V2 is closed and the first exhaust period A2 is ended, and the second intake valve V3 is closed and the second intake period A3 is ended (the second end timing t4). The second drive piston 22*b* and the second displacer 20*b* continue moving toward the bottom dead center LP. In this way, the expansion chamber 34 of the second cold head 14*b* is decreased in volume and the low-pressure gas is discharged therefrom.

On the other hand, if the second intake period A3 is started, the room temperature chamber 36 of the first cold head 14*a* is connected to the discharge port of the compressor 12. In this case, the first displacer 20*a* is located at or near the bottom dead center LP of the first cylinder 26*a*. A high-pressure gas is supplied from the discharge port of the compressor 12 to the room temperature chamber 36 of the first cold head 14*a*. The gas is cooled while passing through the regenerator 15, and enters the expansion chamber 34 of the first cold head 14*a*.

Additionally, if the first exhaust period A2 is started, the first compartment 46*a* of the first drive chamber 28*a* is connected to the intake port of the compressor 12. Therefore, the first drive chamber 28*a* has a pressure lower than the room temperature chamber 36 and the expansion chamber 34, and as illustrated in FIG. 6, the upward driving force acts on the first drive piston 22*a* of the first cold head 14*a*. The first drive piston 22*a* and the first displacer 20*a* move from the bottom dead center LP toward the top dead center UP, and the expansion chamber 34 of the first cold head 14*a* is filled with a high-pressure gas.

In this way, an intake process is performed in the first cold head 14*a*, and in parallel with this, an exhaust process is performed in the second cold head 14*b*. In the GM cryocooler 10, the first cold head 14*a* is driven in the same cycle as and in an opposite phase to the second cold head 14*b*.

As the first cold head 14*a* and the second cold head 14*b* repeat such a cooling cycle (that is, the GM cycle), the respective cooling stages 38 are cooled. Accordingly, the GM cryocooler 10 can cool a superconducting device (for example, a superconducting cable) or other object to be cooled (not illustrated) that are thermally combined with the cooling stage 38.

Figure 7:
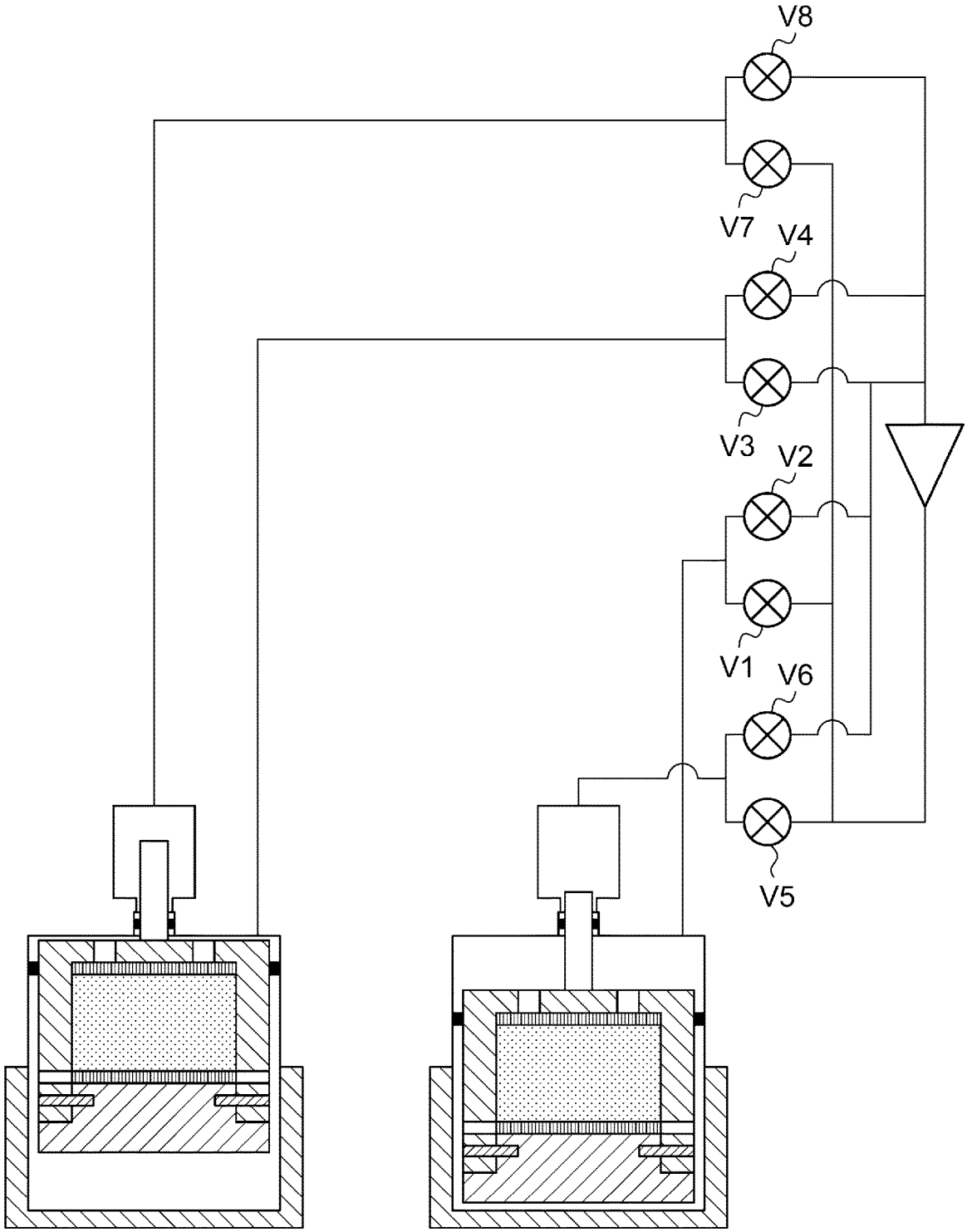
FIG. 7 is a schematic view illustrating a GM cryocooler related to a comparative example.

FIG. 7 is a schematic view illustrating a GM cryocooler related to a comparative example. Typical gas-driven GM cryocoolers have a set of an intake valve and an exhaust valve for intake and exhaust of an expansion chamber, and has another set of an intake valve and an exhaust valve for intake and exhaust of a drive chamber. That is, four valves of one GM cryocooler are required. Therefore, two-cylinder type GM cryocoolers have eight valves V1 to V8 as illustrated. The number of valves is large, and the configuration of flow paths and a drive unit become complicated.

However, according to the GM cryocooler 10 related to the first embodiment, the valve unit 54 is shared by the first cold head 14*a* and the second cold head 14*b*. The intake and exhaust timings to the first drive chamber 28*a* of the first cold head 14*a* and the second cylinder 26*b* of the second cold head 14*b* are controlled by a set of shared intake/exhaust valves, that is, the first intake valve V1 and the first exhaust valve V2. The intake and exhaust timings to the second drive chamber 28*b* of the second cold head 14*b* and the first cylinder 26*a* of the first cold head 14*a* are controlled by another set of shared intake/exhaust valves, that is, the second intake valve V3 and the second exhaust valve V4. In this way, since the two cold heads are driven by the four valves, the drive unit of the GM cryocooler 10 can be made simpler and more small-sized.

Second Embodiment

Figure 8:
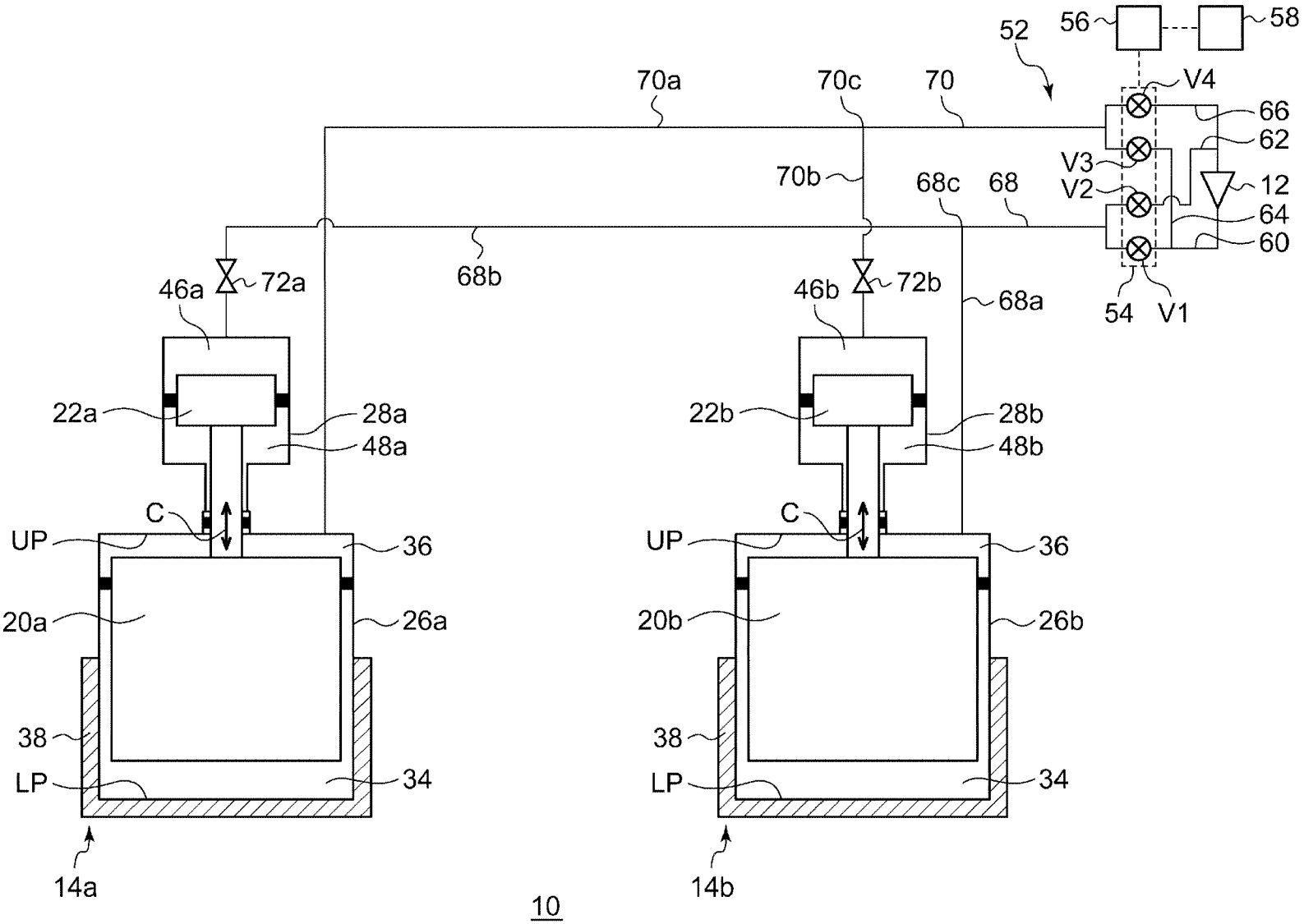
FIG. 8 is a schematic view illustrating a GM cryocooler related to a second embodiment.

FIG. 8 is a schematic view illustrating a GM cryocooler 10 related to a second embodiment. The GM cryocooler 10 related to the second embodiment is the same as the GM cryocooler 10 related to the first embodiment except that a flow path resistance part, such as an orifice, is added between a drive chamber and a valve unit.

The first sub-flow path 68*b* includes a first flow path resistance part 72*a* between the first branch point 68*c* and the first drive chamber 28*a*. The first flow path resistance part 72*a* increases the flow path resistance of the first sub-flow path 68*b* with respect to the first main flow path 68*a*. The second sub-flow path 70*b* includes a second flow path resistance part 72*b* between the second branch point 70*c* and the second drive chamber 28*b*. The second flow path resistance part 72*b* increases the flow path resistance of the second sub-flow path 70*b* with respect to the second main flow path 70*a*. The GM cryocooler 10 may include at least one of the first flow path resistance part 72*a* and the second flow path resistance part 72*b*.

Figure 9:
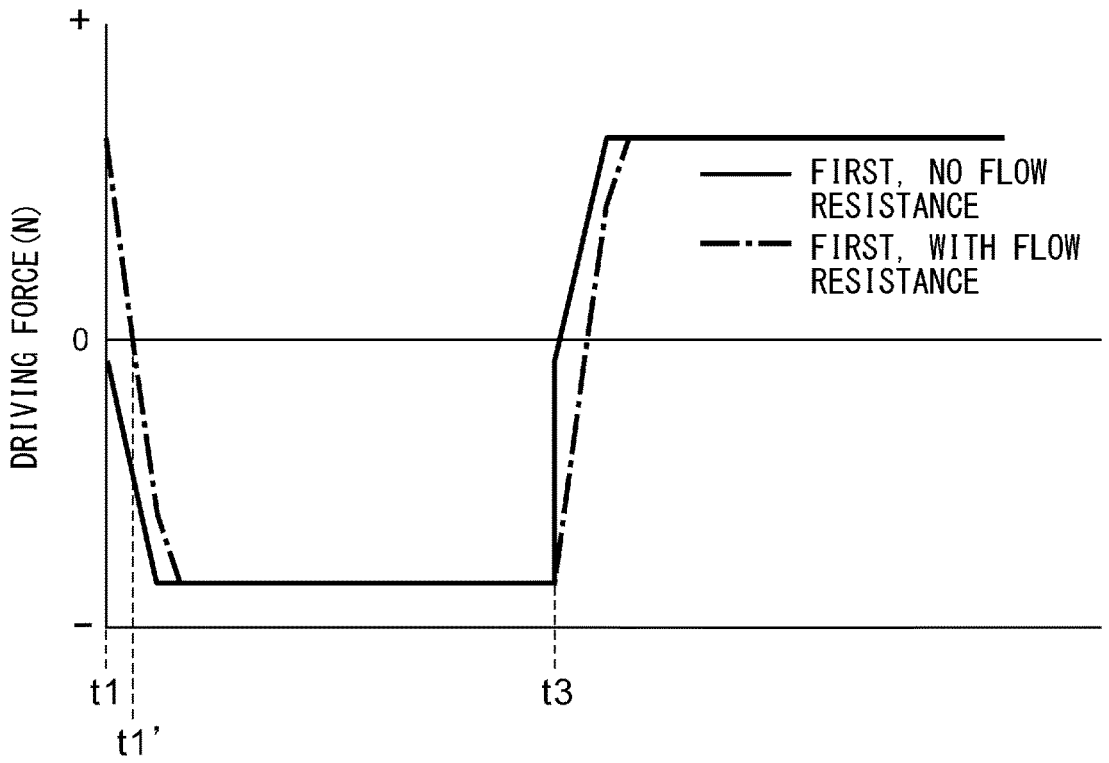
FIG. 9 is a view that illustrates the driving force of the GM cryocooler.

Changes in driving force of the first cold head 14*a* in the exhaust process (the second exhaust period A4 illustrated in FIG. 3) of the first cold head 14*a* are illustrated in FIG. 9. In FIG. 6, in the axial direction, an upward driving force is represented as positive, and a downward driving force is represented as negative. The changes in driving force of the first cold head 14*a* in FIG. 6 illustrating a case where there is no flow path resistance part are together illustrated for comparison in FIG. 9.

Since the first flow path resistance part 72*a* is provided, in the exhaust process of the first cold head 14*a*, a delay occurs in pressure reduction of the first drive chamber 28*a* with respect to pressure reduction of the expansion chamber 34. Accordingly, rising of a downward driving force that acts on the first drive piston 22*a* can be delayed. As illustrated in FIG. 9, the upward driving force acts on the first drive piston 22*a* from the first start timing t1 to a timing t1'. The speed just before the first drive piston 22*a* reaches the bottom dead center LP can be reduced. Therefore, a contact or collision in a cold head can be suppressed, and vibration or abnormal noise of the GM cryocooler 10 can be reduced.

Also in the second embodiment, similarly to the first embodiment, the two cold heads are driven by the four valves. Therefore, the drive unit of the GM cryocooler 10 can be made simpler and more small-sized.

In addition, also in third to fifth embodiments to be described below, at least one of the first flow path resistance part 72*a* and the second flow path resistance part 72*b* may be provided similarly to the second embodiment.

Third Embodiment

Figure 10:
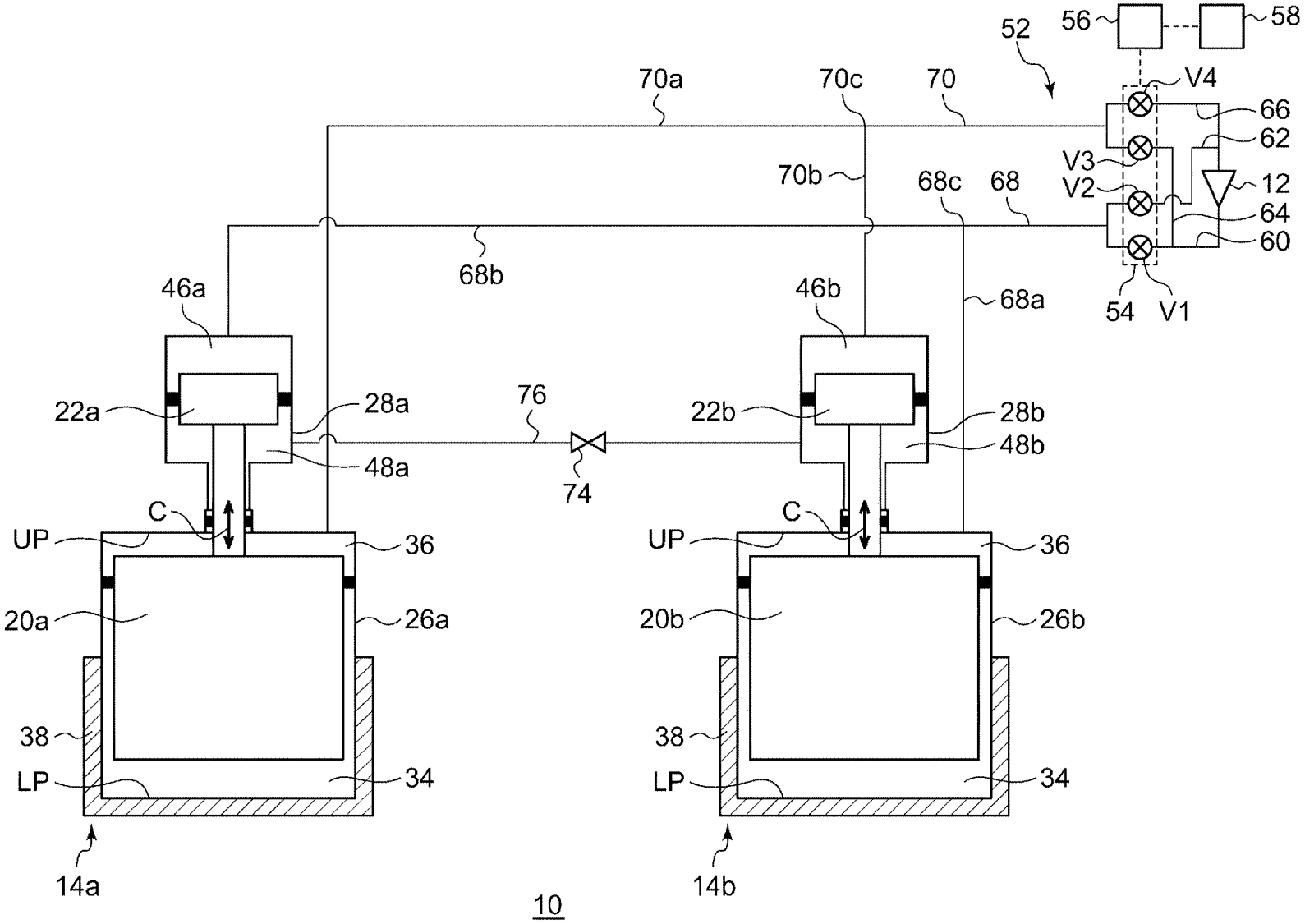
FIG. 10 is a schematic view illustrating the GM cryocooler related to the third embodiment.

FIG. 10 is a schematic view illustrating a GM cryocooler 10 related to a third embodiment. The GM cryocooler 10 related to the third embodiment is the same as the GM cryocooler 10 related to the first embodiment except that a third flow path resistance part 74, such as an orifice, which allows the first gas spring chamber 48*a* and the second gas spring chamber 48*b* to communicate with each other, is added.

The GM cryocooler 10 includes a shunt flow path 76 that allows the first gas spring chamber 48*a* to communicate with the second gas spring chamber 48*b*. The third flow path resistance part 74 is disposed in the middle of the shunt flow path 76. The shunt flow path 76 is a communication path that directly connects the first gas spring chamber 48*a* and the second gas spring chamber 48*b* to each other.

Similarly to the first embodiment, the gas stored in the first gas spring chamber 48*a* is compressed when the first drive piston 22*a* moves downward, and the pressure thereof is increased. A contact or collision in the first cold head 14*a* is suppressed, and vibration or abnormal noise of the GM cryocooler 10 can be reduced. Additionally, since the third flow path resistance part 74 is provided, pressure can be released from the first gas spring chamber 48*a* through the third flow path resistance part 74 and the shunt flow path 76 to the second gas spring chamber 48*b* in a case where the first drive piston 22*a* excessively moves downward and the first gas spring chamber 48*a* is excessively raised in pressure. Therefore, the first drive chamber 28*a* is protected.

The second gas spring chamber 48*b* also functions similarly, and a contact or collision in the second cold head 14*b* is suppressed. Additionally, since pressure can be released from the second gas spring chamber 48*b* to the first gas spring chamber 48*a*, the second drive chamber 28*b* is protected from an excessive pressure.

Also in the third embodiment, similarly to the first embodiment, the two cold heads are driven by the four valves. Therefore, the drive unit of the GM cryocooler 10 can be made simpler and more small-sized.

Fourth Embodiment

Figure 11:
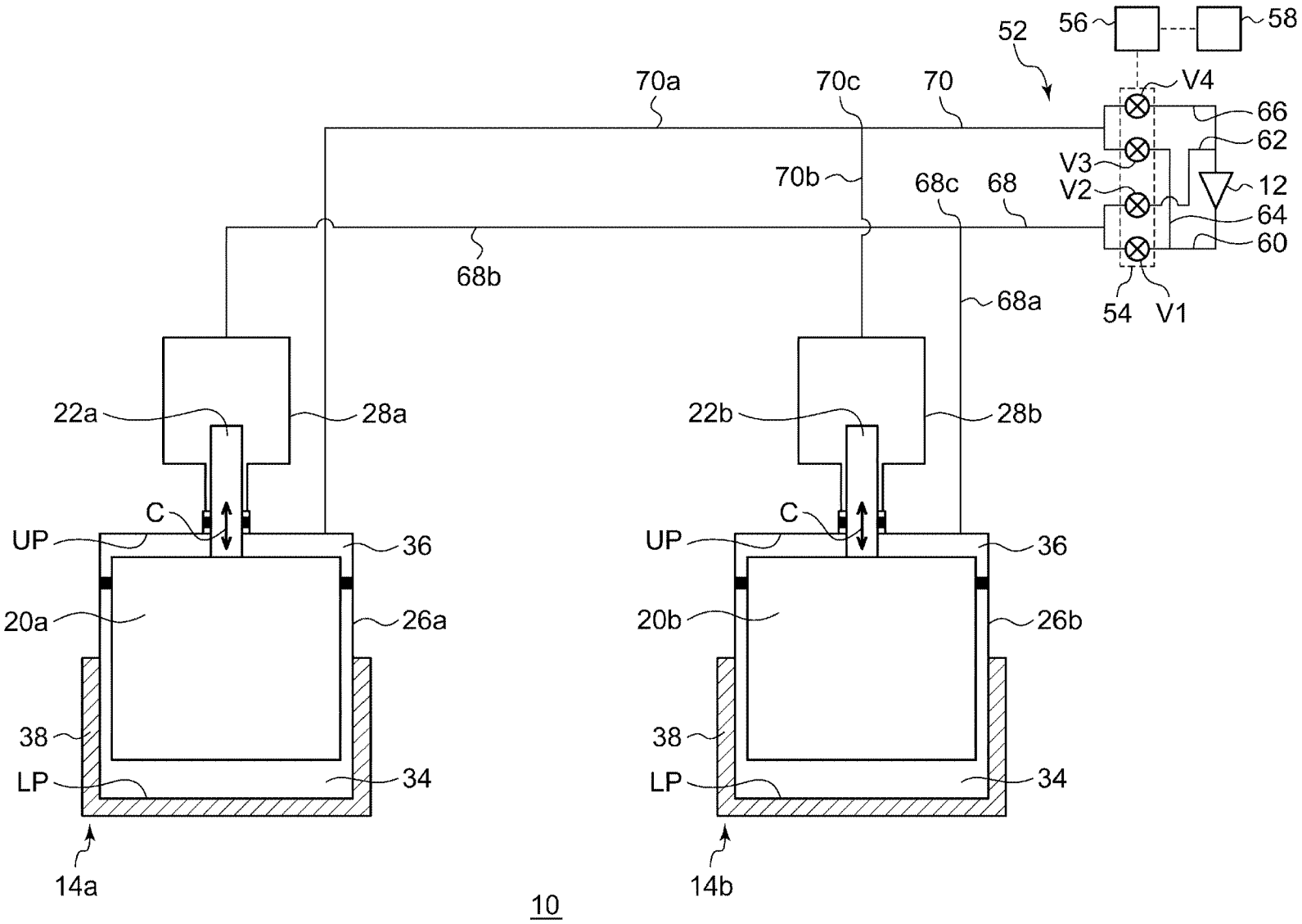
FIG. 11 is a schematic view illustrating the GM cryocooler related to the fourth embodiment.

FIG. 11 is a schematic view illustrating a GM cryocooler 10 related to a fourth embodiment. The GM cryocooler 10 related to the fourth embodiment is the same as the GM cryocooler 10 related to the first embodiment except for not including the first gas spring chamber 48*a* and the second gas spring chamber 48*b*. That is, the first drive chamber 28*a* is formed as one gas chamber, and the first drive piston 22*a* is a first drive rod that extends from the first displacer 20*a* to the gas chamber. Similarly, the second drive chamber 28*b* is formed as one gas chamber, and the second drive piston 22*b* is a second drive rod that extends from the second displacer 20*b* to the gas chamber. Even in this way, similarly to the first embodiment, the two cold heads are driven by the four valves. Therefore, the drive unit of the GM cryocooler 10 can be made simpler and more small-sized.

Fifth Embodiment

Figure 12:
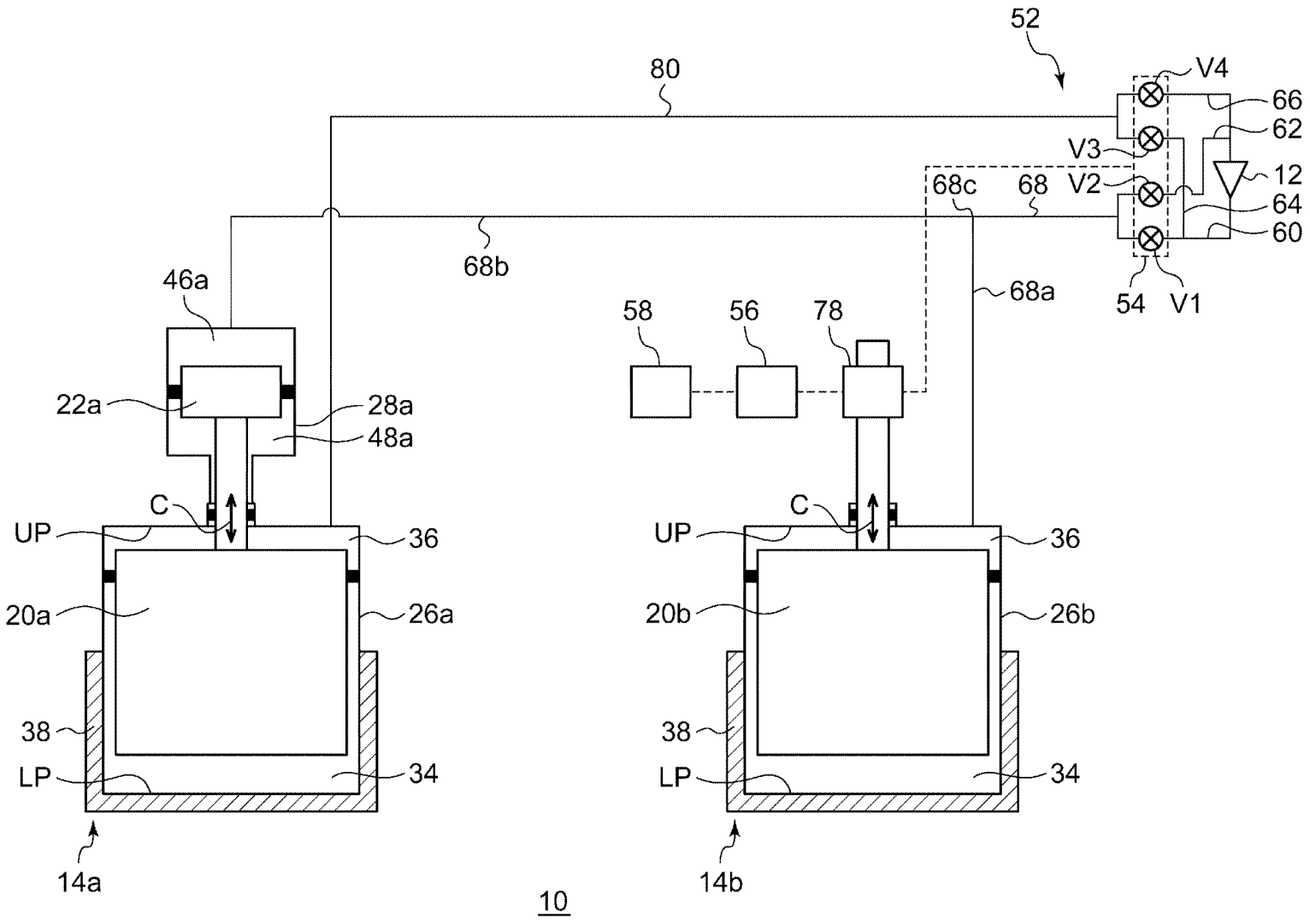
FIG. 12 is a schematic view illustrating a GM cryocooler related to a fifth embodiment.

FIG. 12 is a schematic view illustrating a GM cryocooler 10 related to a fifth embodiment. The GM cryocooler 10 related to the fifth embodiment is the same as the GM cryocooler 10 related to the first embodiment except that the second cold head 14*b* is of a motor driven type.

The second cold head 14*b* includes a coupling mechanism (for example, a scotch yoke mechanism) 78 that couples the rotational driving source 56 to the second displacer 20*b* so as to reciprocate the second displacer 20*b* in the axial direction. The rotational driving source 56 is also coupled to the valve unit 54 so as to rotationally drive the valve unit 54.

Similarly to the above-described embodiment, the first cold head 14*a* that is of the gas driven type is connected to the second intake valve V3 and the second exhaust valve V4 for intake and exhaust of the first cylinder 26*a*. The room temperature chamber 36 of the first cold head 14*a* is connected to the second intake valve V3 and the second exhaust valve V4 through an intake/exhaust flow path 80. The first branch flow path 68 connects the first drive chamber 28*a* to both the first intake valve V1 and the first exhaust valve V2, and connects the second cylinder 26*b* to both the first intake valve V1 and the first exhaust valve V2.

Even in this way, similarly to the first embodiment, the two cold heads are driven by the four valves. Therefore, the drive unit of the GM cryocooler 10 can be made simpler and more small-sized.

Sixth Embodiment

Figure 13:
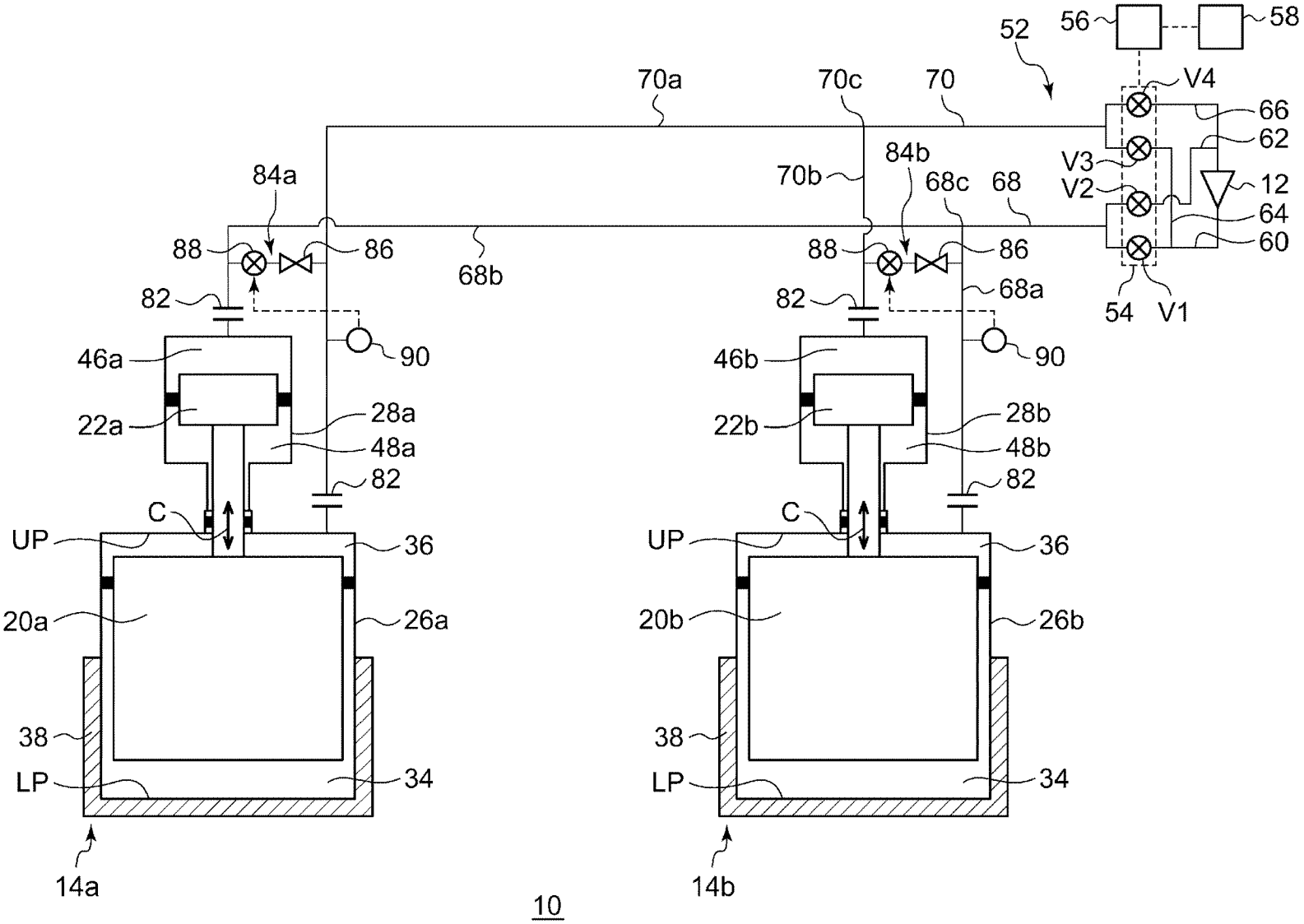
FIG. 13 is a schematic view illustrating a GM cryocooler related to a sixth embodiment.

FIG. 13 is a schematic view illustrating a GM cryocooler 10 related to a sixth embodiment. The GM cryocooler 10 related to the sixth embodiment is the same as the GM cryocooler 10 related to the first embodiment except that the first cold head 14*a* and the second cold head 14*b* are easily detachable from the working gas circuit 52, respectively.

The GM cryocooler 10 includes a valve separation mechanism that can individually separate the first cold head 14*a* and the second cold head 14*b* from the valve unit 54. As an example of the valve separation mechanism, the working gas circuit 52 is provided with a detachable joint 82, such as a self-sealing coupling.

Detachable joints 82 are respectively provided in the first sub-flow path 68*b* and the second main flow path 70*a*. Therefore, the first drive chamber 28*a* of the first cold head 14*a* is detachable from the first sub-flow path 68*b*, and the first cylinder 26*a* of the first cold head 14*a* is detachable from the second main flow path 70*a*. Additionally, detachable joints 82 are respectively provided in the first main flow path 68*a* and the second sub-flow path 70*b*. Therefore, the second drive chamber 28*b* of the second cold head 14*b* is detachable from the second sub-flow path 70*b*, and the second cylinder 26*b* of the second cold head 14*b* is detachable from the first main flow path 68*a*.

The working gas circuit 52 includes a first bypass flow path 84*a* and a second bypass flow path 84*b*. The first bypass flow path 84*a* connects the second main flow path 70*a* to the first sub-flow path 68*b*, and is configured so as to allow the working gas to flow therethrough when the first cold head 14*a* is not installed. The second bypass flow path 84*b* connects the first main flow path 68*a* to the second sub-flow path 70*b*, and is configured so as to allow the working gas to flow therethrough when the second cold head 14*b* is not installed. The first bypass flow path 84*a* and the second bypass flow path 84*b* are disposed on the valve unit 54 side with respect to the joint 82.

The first bypass flow path 84*a* includes a fourth flow path resistance part 86 and an on-off valve 88. The fourth flow path resistance part 86 and the on-off valve 88 are connected in series. The fourth flow path resistance part 86 is provided in order to give an appropriate flow path resistance to the first bypass flow path 84*a*. The on-off valve 88 is closed when the first cold head 14*a* is connected to the working gas circuit 52, and is opened when the first cold head 14*a* is detached. The on-off valve 88 is openable and closable, for example, manually.

Alternatively, the on-off valve 88 may be automatically opened and closed on the basis of a working gas flow rate detected by a flow rate sensor 90. The flow rate sensor 90 is provided in the second main flow path 70*a* so as to detect a working gas flow rate in the second main flow path 70*a*. The flow rate sensor 90 may be provided in the first sub-flow path 68*b* so as to detect a working gas flow rate in the first sub-flow path 68*b*. The on-off valve 88, for example, is closed when a working gas flow rate to be detected exceeds a flow rate threshold and is opened when the working gas flow rate to be detected falls below the flow rate threshold.

Similarly to the first bypass flow path 84*a*, the second bypass flow path 84*b* includes a fourth flow path resistance part 86 and an on-off valve 88. The on-off valve 88 is closed when the second cold head 14*b* is connected to the working gas circuit 52, and is opened when the second cold head 14*b* is detached. For automatic opening and closing of the second bypass flow path 84*b*, the flow rate sensor 90 may be provided in the first main flow path 68*a* (or the second sub-flow path 70*b*).

In addition, the fourth flow path resistance part 86 and the on-off valve 88 may be replaced with one flow rate control valve. The working gas flow rate of the first bypass flow path 84*a* (or the second bypass flow path 84*b*) may be adjusted by the flow rate control valve on the basis of the working gas flow rate detected by the flow rate sensor 90.

Figure 14:
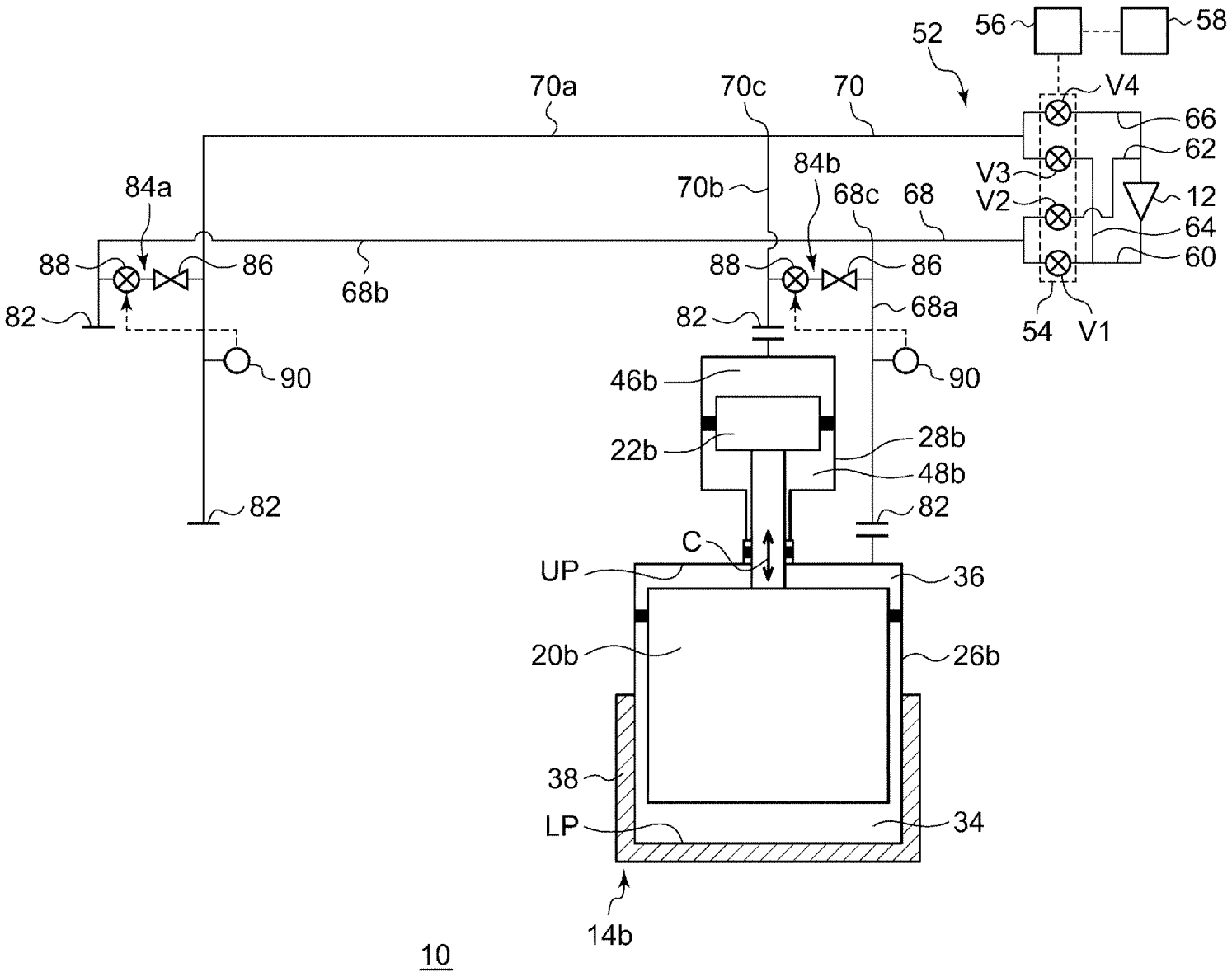
FIG. 14 is a schematic view illustrating the GM cryocooler related to a sixth embodiment.
Figure 15:
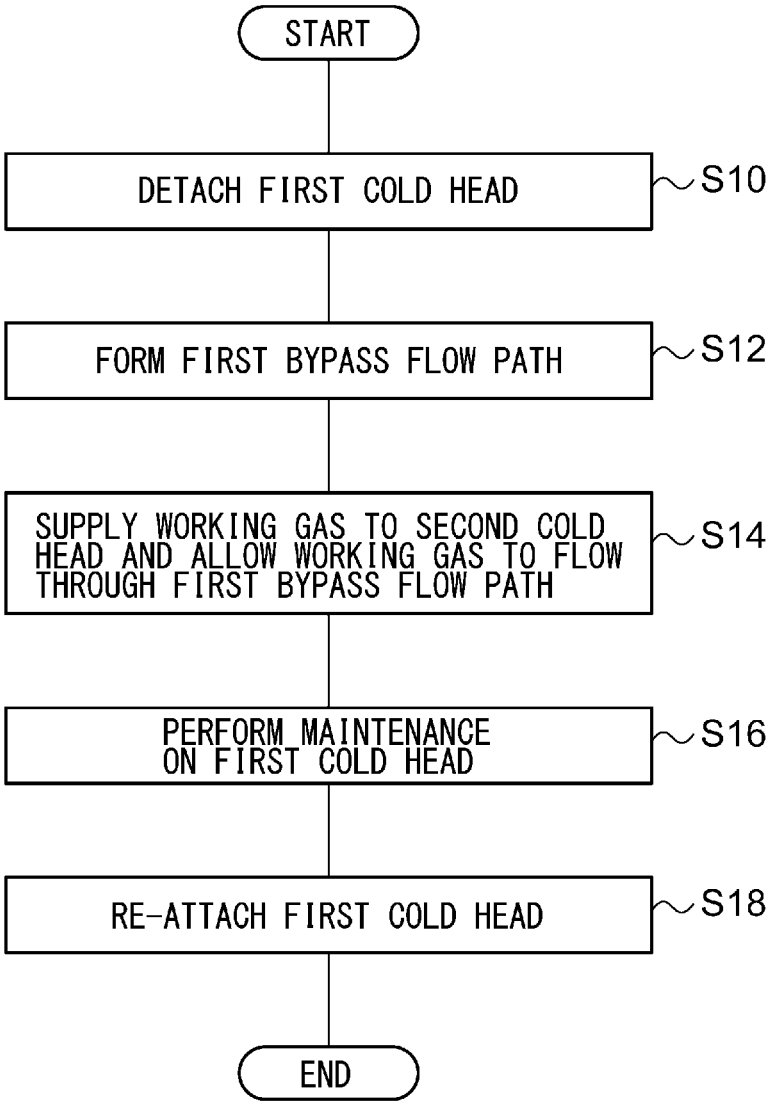
FIG. 15 is a flowchart illustrating a method of operating the GM cryocooler related to the sixth embodiment.

A GM cryocooler 10 related to a sixth embodiment in a state where the second cold head 14*b* is installed, while the first cold head 14*a* is detached from the GM cryocooler 10 is illustrated in FIG. 14. FIG. 15 is a flowchart illustrating a method of operating the GM cryocooler 10 related to the sixth embodiment.

First, an operator detaches the first cold head 14*a* from the GM cryocooler 10 (S10). The first cold head 14*a* is detached from the GM cryocooler 10 by detaching the first drive chamber 28*a* from the first sub-flow path 68*b* and detaching the first cylinder 26*a* from the second main flow path 70*a*.

The first bypass flow path 84*a* is formed (S12). The first bypass flow path 84*a* is formed as the operator manually opens the on-off valve 88 after the first cold head 14*a* is detached. Alternatively, with the detachment of the first cold head 14*a*, the working gas flow rates of the second main flow path 70*a* and the first sub-flow path 68*b* decrease or become almost zero. The flow rate sensor 90 may detect this, the on-off valve 88 may be opened, and the first bypass flow path 84*a* may be formed.

While the first cold head 14*a* is detached from the GM cryocooler 10, a working gas is supplied to the second cold head 14*b* installed in the GM cryocooler 10 (S14). The operation of the second cold head 14*b* is continued. Accordingly, thereby, the GM cryocooler 10 can continue cooling of an object to be cooled.

Additionally, while the first cold head 14*a* is detached from the GM cryocooler 10, the working gas flows to the first bypass flow path 84*a* (S14). The first bypass flow path 84*a* has a role of making the working gas bypass the second cold head 14*b* such that the flow rate of the working gas to be supplied to the second cold head 14*b* when the first cold head 14*a* is not installed does not excessively exceed the standard flow rate of the working gas to be supplied to the second cold head 14*b* when the first cold head 14*a* is installed.

The operator performs maintenance on the detached first cold head 14*a* (S16). After the completion of the maintenance, the operator attaches the first cold head 14*a* to the GM cryocooler 10 again (S18). In this way, the two sets of cold heads are operated again.

Similarly, the operator can detach the second cold head 14*b* from the GM cryocooler 10 to perform maintenance. In this case, the second bypass flow path 84*b* is formed. While the second cold head 14*b* is detached from the GM cryocooler 10, the working gas is supplied to the installed first cold head 14*a*, and the working gas flows to the second bypass flow path 84*b*.

In this way, the operator can easily detach a cold head from the GM cryocooler 10 during the operation of the GM cryocooler 10. While continuing the operation of any one of the cold heads, the operator can detach any other cold head from the GM cryocooler 10 to perform maintenance. Alternatively, the operator can replace the detached cold head with a new article or a cold head subjected to maintenance.

Additionally, the GM cryocooler 10 is provided with the first bypass flow path 84*a* and the second bypass flow path 84*b*. Assuming that there are no such bypass flow paths, in a case where one cold head is detached, the working gas that is supposed to be supplied to the two cold heads will be concentratedly supplied to the other cold head under operation. Then, the working gas that flows to the cold head under operation becomes excessive. As a result, for example, a disadvantage may occur that an excessive high pressure acts on the cold head. However, practically, since the working gas can escape through a bypass flow path, the operation of the GM cryocooler 10 can be stably continued similarly to before the detachment of the cold head.

In a typical maintenance method, first, the operation of the GM cryocooler is stopped, the temperature of an object to be cooled is raised, and then, maintenance of the cold heads is performed. Then, the GM cryocooler should be re-activated and the object to be cooled should be re-cooled. In this way, the maintenance is completed. Generally, since the temperature rise and re-cooling of the object to be cooled take substantial time, a long time is required from the start of the maintenance to the completion of the maintenance. However, according to the GM cryocooler 10 related to the sixth embodiment, a cold head can be detached and subjected to maintenance without raising the temperature of the object to be cooled in the GM cryocooler 10. Since it is not necessary to consider the temperature rise and re-cooling of the object to be cooled for the maintenance, the maintenance can be completed in short time.

Figure 16:
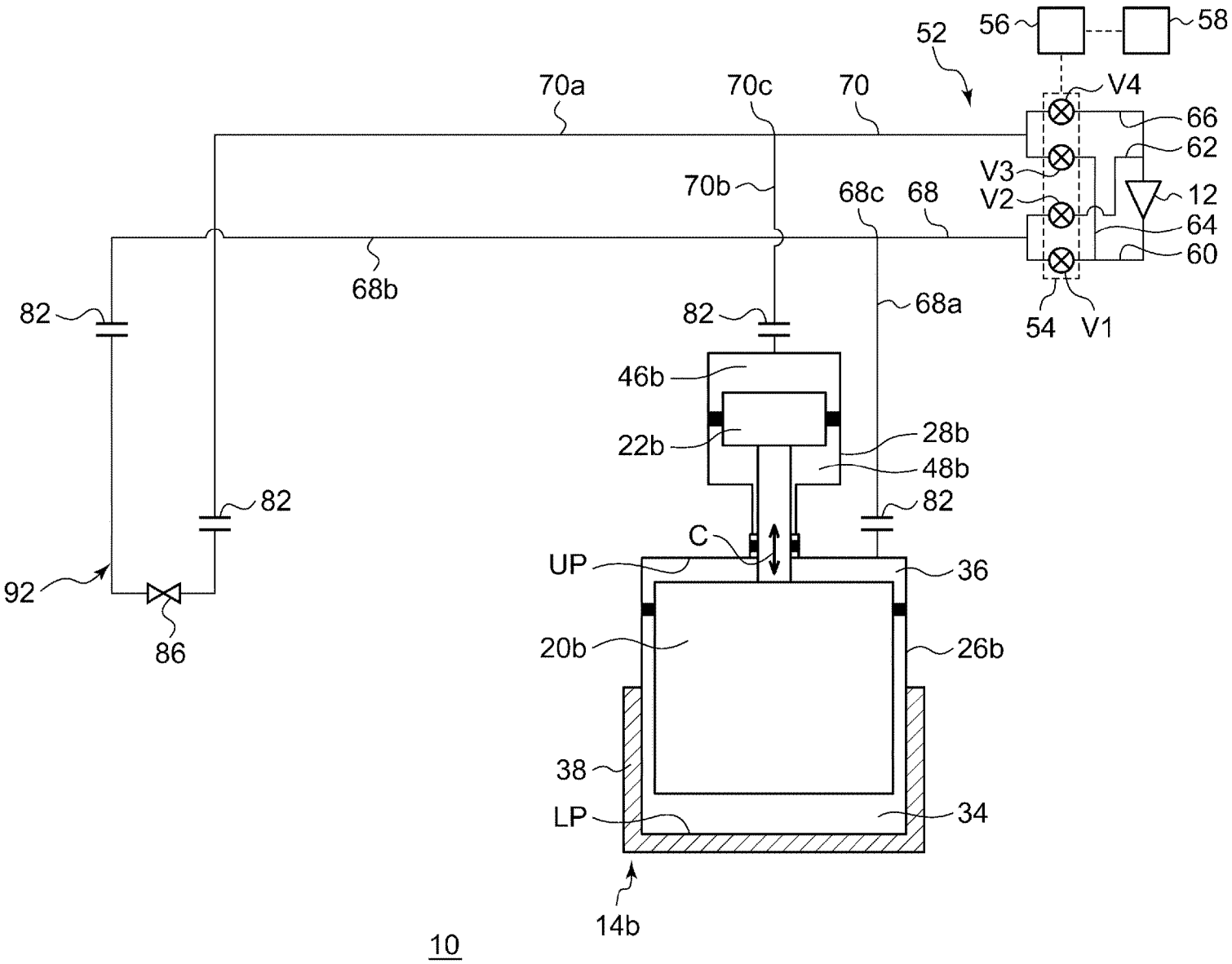
FIG. 16 is a schematic view illustrating an alternative example of a bypass flow path provided in the GM cryocooler related to the sixth embodiment.

An alternative embodiment regarding the bypass flow paths is illustrated in FIG. 16. As illustrated, the GM cryocooler 10 does not include the first bypass flow path 84*a* and the second bypass flow path 84*b*. Instead, when the first cold head 14*a* is detached, the substitute bypass pipe 92 is attached to the working gas circuit 52. It can be said that the bypass pipe 92 forms a first bypass flow path that connects the second main flow path 70*a* to the first sub-flow path 68*b*. The bypass pipe 92 may prepare the fourth flow path resistance part 86 if required. When the first cold head 14*a* is again attached to the GM cryocooler 10, the bypass pipe 92 is detached and the first cold head 14*a* is attached instead. Even in this way, similarly to the first bypass flow path 84*a* illustrated in FIGS. 13 and 14, the effect of suppressing excessive supply of the working gas to the second cold head 14*b* can be exhibited.

Similarly, when the second cold head 14*b* is detached, the bypass pipe 92 can be attached instead, and a second bypass flow path that connects the first main flow path 68*a* to the second sub-flow path 70*b* can be formed.

Figure 17:
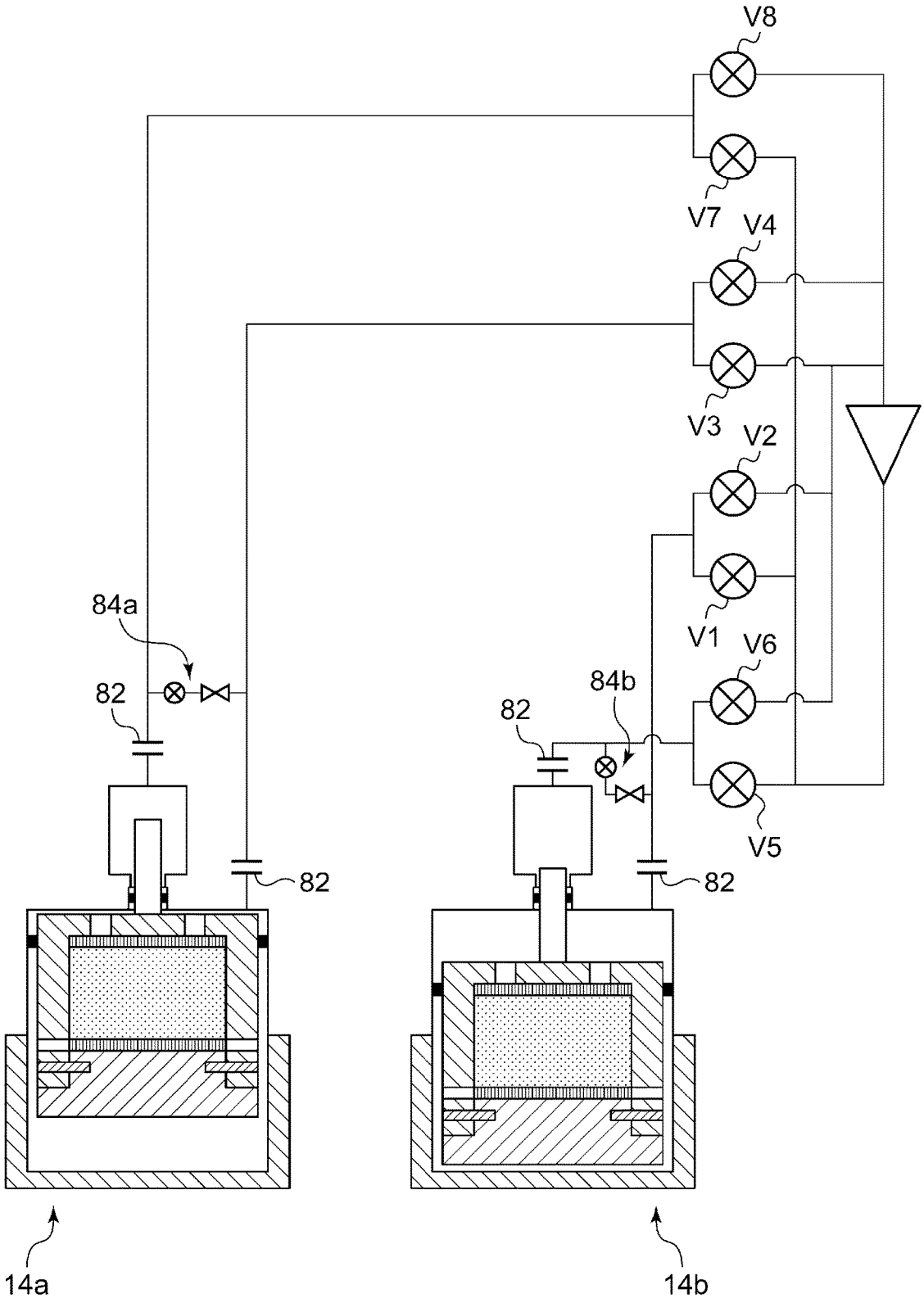
FIG. 17 is a schematic view illustrating another example of the GM cryocooler related to the sixth embodiment.
Figure 18:
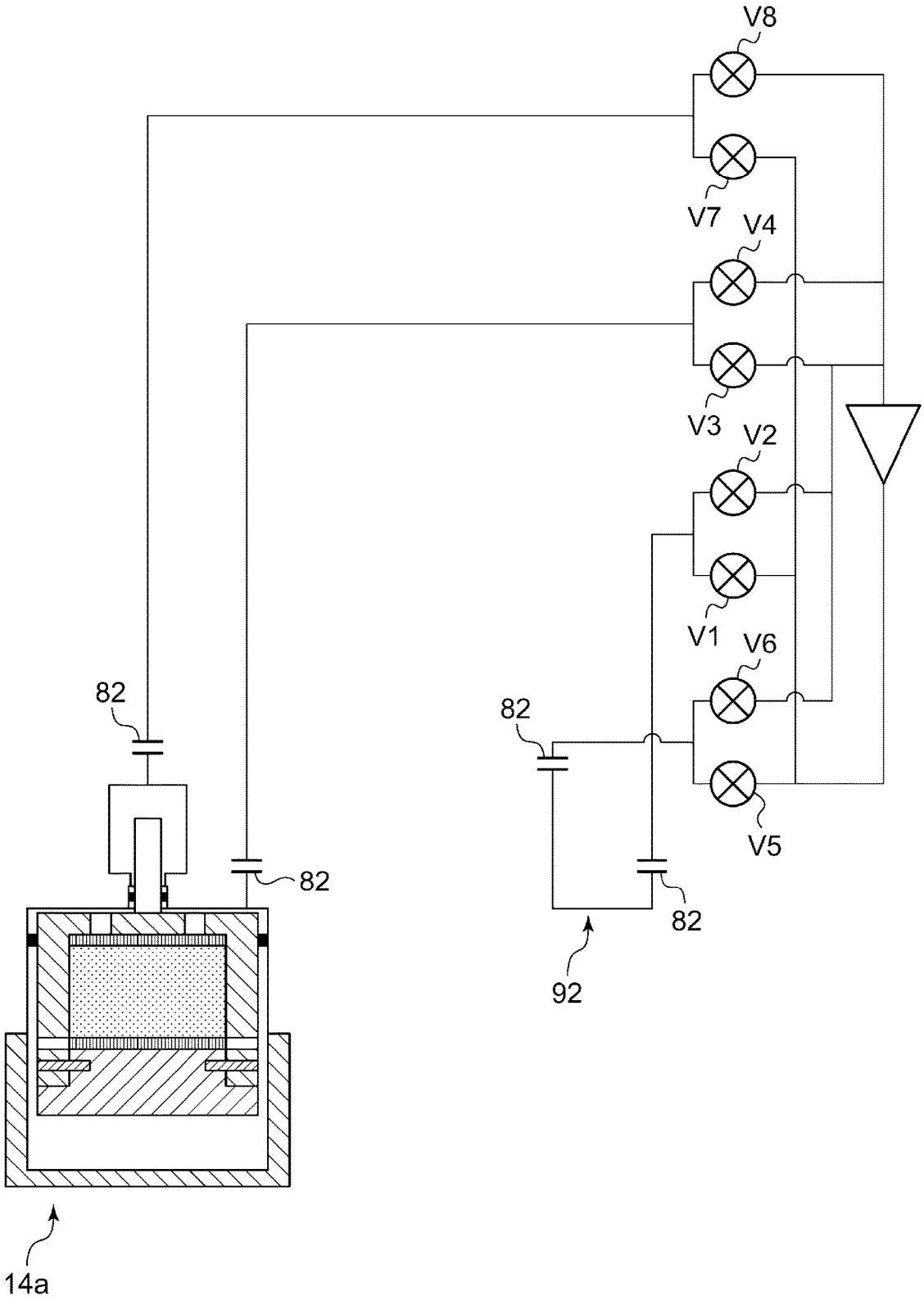
FIG. 18 is a schematic view illustrating still another example of the GM cryocooler related to the sixth embodiment.

The above-described bypass configuration can also be similarly applied to the two-cylinder type GM cryocooler 10 with eight valves V1 to V8 illustrated in FIG. 7, and thereby, the same effect can be exhibited. As illustrated in FIG. 17, in the GM cryocooler 10, the first cold head 14*a* and the second cold head 14*b* are made individually detachable by joints 82, respectively. The first bypass flow path 84*a* is provided between the first cold head 14*a* and a first valve group (V3, V4, V7, and V8), and the second bypass flow path 84*b* is provided between the second cold head 14*b* and a second valve group (V1, V2, V5, and V6). Alternatively, as illustrated in FIG. 18, when the second cold head 14*b* (or the first cold head 14*a*) is detached, the substitute bypass pipe 92 may be attached.

The invention has been described above on the basis of the embodiments. It should be understood by those skilled in the art that the invention is not limited to the above embodiments, that various design changes are possible and various modification examples are possible, and that such modification examples are also within the scope of the invention.

In the above-described embodiment, one valve unit 54 is provided in one compressor 12, and the two cold heads are driven. In a certain embodiment, two valve units 54 may be connected in parallel to one compressor 12. By driving the two cold heads by the valve units 54, respectively, a four-cylinder type GM cryocooler having one compressor 12 and four cold heads can also be configured. Similarly, a GM cryocooler having one compressor 12 and even cold heads can also be configured.

Various features described in relation to a certain embodiment can also be applied to other embodiments. New embodiments created by combination have the effects of respective combined embodiments in combination. For example, the bypass flow paths described in relation to the sixth embodiment may be applied to any of the first embodiment to the fifth embodiment.

The invention is applicable to the field of the GM cryocooler.

It should be understood that the invention is not limited to the above-described embodiment, but may be modified into various forms on the basis of the spirit of the invention. Additionally, the modifications are included in the scope of the invention.

What is claimed is:

1. A GM cryocooler comprising:

a first cold head including:

a first displacer that is reciprocable in an axial direction, a first cylinder that houses the first displacer, a first drive piston that drives the first displacer in the axial direction, and a first drive chamber that houses the first drive piston;

a second cold head including:

a second displacer that is reciprocable in the axial direction, a second cylinder that houses the second displacer, a second drive piston that drives the second displacer in the axial direction, and a second drive chamber that houses the second drive piston;

a first intake valve that is connected to both the first drive chamber and the second cylinder so as to supply a working gas in parallel to the first drive chamber and the second cylinder;

a first exhaust valve that is connected to both the first drive chamber and the second cylinder so as to collect the working gas in parallel from the first drive chamber and the second cylinder;

a second intake valve that is connected to both the second drive chamber and the first cylinder so as to supply the working gas in parallel to the second drive chamber and the first cylinder; and a second exhaust valve that is connected to both the second drive chamber and the first cylinder so as to collect the working gas in parallel from the second drive chamber and the first cylinder.

2. The GM cryocooler according to claim 1, wherein the first intake valve supplies the working gas to the first drive chamber and the second cylinder during a first intake period, wherein the first exhaust valve collects the working gas from the first drive chamber and the second cylinder during a first exhaust period, wherein the second intake valve supplies the working gas to the second drive chamber and the first cylinder during a second intake period, wherein the second intake period overlaps the first exhaust period at least partially, and wherein the second exhaust valve collects the working gas from the second drive chamber and the first cylinder during a second exhaust period, wherein the second exhaust period overlaps the first intake period at least partially.

3. The GM cryocooler according to claim 2, wherein the second intake period is delayed from the first intake period, and/or wherein the second exhaust period is delayed from the first exhaust period.

4. The GM cryocooler according to claim 1, further comprising:

a first branch flow path that includes a first main flow path connected to the second cylinder and a first sub-flow path connected to the first drive chamber, wherein the first branch flow path connects each of the first intake valve and the first exhaust valve to both the first main flow path and first sub-flow path; and a second branch flow path that includes a second main flow path connected to the first cylinder and a second sub-flow path connected to the second drive chamber, wherein the second branch flow path connects each of the second intake valve and the second exhaust valve to both the second main flow path and the second sub-flow path.

5. The GM cryocooler according to claim 4, wherein the first branch flow path includes a first branch point where the first sub-flow path branches from the first main flow path, and the first sub-flow path includes a first flow path resistance part between the first branch point and the first drive chamber, and/or wherein the second branch flow path includes a second branch point where the second sub-flow path branches from the second main flow path, and the second sub-flow path includes a second flow path resistance part between the second branch point and the second drive chamber.

6. The GM cryocooler according to claim 4, further comprising:

a first bypass flow path that connects the second main flow path to the first sub-flow path, the first bypass flow path being configured so as to allow the working gas to flow therethrough when the first cold head is not installed; and a second bypass flow path that connects the first main flow path to the second sub-flow path, the second bypass flow path being configured so as to allow the working gas to flow therethrough when the second cold head is not installed.

7. The GM cryocooler according to claim 1, wherein the first drive chamber includes a first compartment connected to the first intake valve and the first exhaust valve, and a first gas spring chamber partitioned from the first compartment by the first drive piston, and/or wherein the second drive chamber includes a second compartment connected to the second intake valve and the second exhaust valve, and a second gas spring chamber partitioned from the second compartment by the second drive piston.

8. The GM cryocooler according to claim 7, further comprising:

a shunt flow path that allows the first gas spring chamber to communicate with the second gas spring chamber, and the shunt flow path including a flow path resistance part.

9. A GM cryocooler comprising:

a first cold head including a first displacer that is reciprocable in an axial direction, a first drive piston that drives the first displacer in the axial direction, and a first drive chamber that houses the first drive piston;

a second cold head including a second displacer that is reciprocable in the axial direction, and a second cylinder that houses the second displacer;

a first intake valve that is connected to both the first drive chamber and the second cylinder so as to supply a working gas in parallel to the first drive chamber and the second cylinder; and a first exhaust valve that is connected to both the first drive chamber and the second cylinder so as to collect the working gas in parallel from the first drive chamber and the second cylinder.

* * * * *